US011766802B2

(12) United States Patent
Sheriff

(10) Patent No.: US 11,766,802 B2
(45) Date of Patent: Sep. 26, 2023

(54) DIE CUTTER HOLDING AND LIFTING APPARATUS

(71) Applicant: Swanstrom Tools USA Inc., Superior, WI (US)

(72) Inventor: Timothy W. Sheriff, Duluth, MN (US)

(73) Assignee: SWANSTROM TOOLS USA INC., Superior, WI (US)

( * ) Notice: Subject to any disclaimer, the term of this patent is extended or adjusted under 35 U.S.C. 154(b) by 262 days.

(21) Appl. No.: 16/220,237

(22) Filed: Dec. 14, 2018

(65) Prior Publication Data

US 2019/0184594 A1 Jun. 20, 2019

Related U.S. Application Data

(60) Provisional application No. 62/599,290, filed on Dec. 15, 2017.

(51) Int. Cl.

| | |
|---|---|
| ***B26F 1/14*** | (2006.01) |
| ***B26F 1/40*** | (2006.01) |
| ***B26F 1/38*** | (2006.01) |
| ***B26F 1/44*** | (2006.01) |
| ***B21D 28/14*** | (2006.01) |

(52) U.S. Cl.

CPC ..... *B26F 1/14* (2013.01); *B21D 28/14* (2013.01); *B26F 1/3846* (2013.01); *B26F 1/40* (2013.01); *B26F 1/44* (2013.01)

(58) Field of Classification Search

CPC .... B21D 28/12; B21D 28/125; B21D 28/246; B21D 28/343; B26F 1/04; B26F 1/386

USPC .... 83/460, 462, 687, 691, 459; 269/254 CS, 269/254 R

See application file for complete search history.

(56) References Cited

U.S. PATENT DOCUMENTS 771,391 A * 10/1904 Raines ..... B26F 1/36 83/590
985,209 A * 2/1911 Russell ..... B23D 63/003 76/79

(Continued)

FOREIGN PATENT DOCUMENTS

DE 196 10 659 A1 * 9/1997 ..... G10D 13/065

OTHER PUBLICATIONS

SFC Tools, Disc Cutter—Circle 10 Punches—Rubber Base—for Jewelry Making SFC Tools 28-590, retrieved from https://www.amazon.com/Disc-Cutter-Circle-Punches-Jewelry/ . . . on May 26, 2023, originally available date listed as Apr. 7, 2016 (Year: 2016).*

(Continued)

*Primary Examiner* — Evan H MacFarlane

(74) *Attorney, Agent, or Firm* — Faegre Drinker Biddle & Reath LLP

(57) ABSTRACT

Die cutter holding and lifting systems, apparatuses, and methods for use with custom and commercially available die cutters. According to some examples, a system includes a base, a separation assembly, and an actuation assembly. A separation assembly can be coupled to the die cutter, and the die cutter in combination with the separation assembly can be coupled to the base, such that the actuation assembly can be utilized to cause a separation of die plates of the die cutter for increased productivity in cutting, stamping, or pressing operations involving die cutters.

6 Claims, 14 Drawing Sheets

(56) References Cited

U.S. PATENT DOCUMENTS

| | | | | | |
|---|---|---|---|---|---|
| 1,246,353 | A * | 11/1917 | Thigpen | F16B 37/085 | 411/203 |
| 1,388,866 | A * | 8/1921 | Lambert | B25B 13/12 | 81/472 |
| 1,772,885 | A * | 8/1930 | Case | B27M 3/00 | 269/38 |
| 2,017,195 | A * | 10/1935 | Anderson et al. | B26F 1/04 | 83/146 |
| 2,319,377 | A * | 5/1943 | Wallace et al. | B25B 5/02 | 24/523 |
| 3,044,512 | A * | 7/1962 | Jones | B25B 5/068 | 269/254 R |
| 3,185,014 | A * | 5/1965 | Ross | G10D 13/065 | 984/154 |
| 3,496,818 | A * | 2/1970 | Porter et al. | B21D 37/10 | 83/140 |
| 4,111,095 | A * | 9/1978 | Simons | G10D 13/065 | 984/154 |
| 4,274,322 | A * | 6/1981 | Cordes | G10D 13/065 | 84/422.3 |
| 4,517,876 | A * | 5/1985 | Duhon | G10D 13/065 | 84/421 |
| 4,756,141 | A * | 7/1988 | Hirsch et al. | B65B 63/022 | 100/240 |
| 4,817,490 | A * | 4/1989 | Cahill | G10D 13/065 | 984/154 |
| 5,063,819 | A * | 11/1991 | Hoshino | G10D 13/065 | 84/422.3 |
| 2011/0314982 | A1* | 12/2011 | Kubota | B26D 7/025 | 83/136 |

OTHER PUBLICATIONS

"Disc Cutters, Heart Shaped Cutting Tool, Set of 5. 11mm-24mm. Jewellery Making. J1120," [online], [retrieved Feb. 13, 2018]. Retrieved from Proops Brothers.com using the Internet <https://www.proopsbrothers.com/disc-cutters-heart-shaped-cutting-tool-set-of-5-11mm-24mm-jewellery-making-j1120-2008-p.asp>, 1 page.

"Durston Disc Cutter Inch Size," [online]. [retrieved Feb. 8, 2018], Retrieved from Otto Frei using the Internet <http://www.ottofrei.com/Durston-Disc-Cutter-Inch-Size>, 1 page.

"Economy Disc Cutter," [online], [retrieved on Feb. 7, 2018]. Retrieved from W. Durston LTD using the Internet <http://www.durston.co.uk/economy-disc-cutter.htm>, 1 page.

"Heart Disc Cutter," [online], [retrieved Feb. 15, 2018]. Jipsy Metal Industries, retrieved from Indiamart using the Internet <https://www.indiamart.com/proddetail/heart-disc-cutter-9363940697.html>, 1 page.

"Jumbo Pro Quality Disc Cutter With 2 Punches 1.75 and 1.375," [online], [retrieved Feb. 15, 2018]. TDS Online Store, retrieved from ArtFire using the Internet <https://www.artfire.com/ext/shop/product_view/TDSONLINESTORE/9365531/jumbo_pro_quality_disc_cutter_with_2_punches_1_3_4_and_1_3_8_inch/indie_supplies/tools>, 1 page.

"Oval Disc Cutter With Lever for Precious Metal Cutting," [online], [retrieved Feb. 14, 2018]. Retrieved from MekkiSupplies using the Internet <https://www.etsy.com/listing/258619872/oval-disc-cutter-with-lever-for-precious? ga_order=most_relevant&ga_search_type=all&ga_view_type=gallery&ga_search_query=disccutter&ref=sr_gallery-1-2>, 1 page.

"SE JT-SP310 Locking Disc Cutter Set (10 Piece)," [online], [retrieved Feb. 14, 2018]. Retrieved from Amazon using the Internet <https://www.amazon.com/gp/product/B00CPTXKCO/ref=s9u_simh_gw_i1? ie=UTF8&fpl=fresh&pd_rd_i=B00CPTXKCO&pd_rd_r=e62f502f-11a0-11e8-bd6b-0356965b604e&pd_rd_w=CsQwz&pd_rd_wg=dD778&pf_rd_m=ATVPDKIKX0DER&pf_rd_s=&pf_rd_r=NPB1EY076XYZZA8W0AGV&pf_rd_t=36701&pf_rd_p=0411ffec-c026-40ae-aac5-2cd3d48aeeac&pf_rd_i=desktop>, 1 page.

"Tools and Equipment 2016-2017." Rio Grande, pp. 189-191, 2016-2017.

Labanda Tool Catalogue, vol. 1/1, V.1.4.9, Jan. 2017, p. 32.

"0.125" to 1" Pepetools Disc Cutter Set: Model 196.10A," [online], [retrieved on Feb. 6, 2018]. Retrieved from Contenti using the Internet <https://contenti.com/1-8-to-1-pepetools-disc-cutter-set>, 2 pages.

"5 Piece Eye Shape Disc Cutter (Pack of: 1)—TJ750H-EY-6," [online], [retrieved on Feb. 14, 2018]. Retrieved from Tool USA.com using the Internet <https://www.toolusa.com/products/tj750h-ey-6>, 1 page.

"7 PC Square Shaped Disc Cutter Metal Puncher 4x4mm-16x16mm Goldsmith Jewelry," [online], [retrieved Feb. 13. 2018]. Retrieved from prolinemax using the Internet <https://www.prolinemax.com/7-PC-Square-Shaped-Disc-Cutter-Metal-Puncher-4x4mm-16x16mm-Goldsmith-Jewelry-_p_1916.html>, 2 pages.

"9 Pc Disc Cutter Set," [online], [retrieved Feb. 7, 2018]. Retrieved from the Hawk Importers 2016 Catalog using the Internet <http://www.hawkimporters.com/SD/searchP.asp>, item TJ7508GH, 1 page.

"Deluxe Disc Cutters," [online], [retrieved Jan. 12, 2018]. Retrieved from Ikohe, Inc. using the Internet <URL:http://www.ikohe.com/394.html>, 1 page, 2003.

"Disc Cutter Puppy Shape," [online], [retrieved Feb. 15, 2018]. Sunrise Tools, retrieved from Alibaba.com using the Internet <https://www.alibaba.com/product-detail/Disc-Cutter-Puppy-Shape_50029257869.html>, 1 page.

"Disc Cutter Set -17," [online], [retrieved Feb. 13, 2018]. Retrieved from Malver Jewelery Tools Productions using the Internet <http://www.malver.net/en/products/CUTTERS/77>, 1 page.

"Disc Cutter Set, Hexagon Shape Assortment With Handle and Allen Wrench, 5 Punch Sizes," [online], [retrieved Feb. 14, 2018]. Retrieved from Beadaholique using the Internet <https://www.beadaholique.com/disc-cutter-set-hexagon-shape-assortment-with-handle-and-allen-wrench-5-punch-sizes.html>, 2 pages.

"Disc Cutter," Sun.B.International Catalogue [online], [retrieved Feb. 14, 2018]. Retrieved using the Internet <URL: http://www.sunbinternational.com/sunb.pdf>, pp. 29-39.

"Disc Cutters—"Square" [JEM-720]," [retrieved Feb. 15, 2018]. Retrieved from JemCo Jeweler's Supply using the Internet <http://www.jemcousa.com/disc-cutters-square-p-3010.html>, 1 page.

* cited by examiner

DIE CUTTER HOLDING AND LIFTING APPARATUS

CROSS-REFERENCE TO RELATED APPLICATION

This application claims priority to Provisional Application No. 62/599,290, filed Dec. 15, 2017, which is herein incorporated by reference in its entirety.

TECHNICAL FIELD

The present disclosure relates to systems, devices, and methods for use with cutting, punching, or stamping metal components for jewelry making. In particular the present disclosure relates to systems, devices, and methods for use with a variety of commercially available die cutters that facilitate the cutting, punching, or stamping of metal components for jewelry.

BACKGROUND

There exists a strong market for manufacturing and crafting tools for use by crafters, including jewelers. While components can be purchased off-the-shelf, a number of crafters opt to make their own components or purchase them from other crafters.

Metal discs, also referred to as stampings, occupy a large category of jewelry components. Ready-made stampings are available, but are more expensive than making stampings on one's own. However, making stampings requires an individual to possess or acquire appropriate tooling, which is also an added expense and varies wildly depending on the tooling type and design. Traditional jewelry die cutters are relatively inexpensive and widely available, but remain inconvenient for high volume production.

Die cutters generally include an upper die plate, a lower die plate, one or more guide pins, a clamping mechanism, and/or one or more punches. In operation, a piece of material is placed between the top plate and bottom die plates, and a mechanism—generally a screw—operates to close and secure the top and bottom die plates such that the material being punched is immobilized. A punch is inserted into a guide hole in the top plate and struck with a mallet or pushed through the material with a press. In most cases, the punched material and punch drop out of the bottom of the die cutter, requiring the die cutter to be lifted to retrieve the punched material and punch. To advance the stock material so that another component can be produced, the top and bottom die plates are separated so that the material can be properly advanced for the next component to be punched. In cases where a screw operates to secure the top and bottom die plates, the screw must be rotated to allow for separation of the top and bottom die plates. This process is repeated for each additional part sought to be produced. Thus, while inexpensive and simple to use, traditional die cutters like those described above have limited productivity in terms of parts per unit of time.

SUMMARY

According to one example, ("Example 1"), a die cutter holding and lifting system includes a base, a riser, a plurality of adjustable stop bars coupled to the riser and configured to position and secure a die cutter to the base, a separation assembly configured to couple to the die cutter and transitionable between an open configuration and a closed configuration, and an actuation assembly coupled to the base and engaging the separation assembly to cause the separation assembly to transition between the open and closed configurations.

According to another example, ("Example 2") further to Example 1, the system further includes a die cutter having a first die plate and a second die plate.

According to another example, ("Example 3") further to Example 2, the first die plate is secured to the riser between the first and second stop bars.

According to another example, ("Example 4") further to Example 3, the first stop bar includes a wedge clamp, wherein the first wedge clamp is engaged with the first die plate to secure the first die plate between the first and second stop bars and to the riser.

According to another example, ("Example 5") further to Example 3, the separation assembly is coupled to the second die plate such that the separation assembly is moveable relative to the first die plate.

According to another example, ("Example 6") further to Example 5, when transitioned to the open configuration, the separation assembly causes a separation between the first and second die plates.

According to another example, ("Example 7") further to Example 1, the separation assembly includes an axial member configured to be coupled to the die cutter, a retention member coupled to the axial member, and a biasing member situated along the axial member in an abutting relationship with the retention member.

According to another example, ("Example 8") further to Example 7, the axial member is coupled to a first die plate of a die cutter such that the axial member and the first die plate are moveable relative to a second die plate of the die cutter.

According to another example, ("Example 9") further to Example 8, the actuation assembly includes a rotatable cam element that is engaged with the retention member of the separation assembly, wherein the cam element is rotatable to cause a translation of the retention member and the axial member of the separation assembly and thereby cause a transition the die cutter between the open and closed configurations.

According to another example, ("Example 10") further to Example 1, the actuation assembly includes a shaft coupled to the cam element, and a lever coupled to the shaft, wherein the lever can be actuated to cause a rotation of the shaft and the cam element.

According to another example, ("Example 11") a die cutter a separation assembly includes an axial member configured to be coupled to a first die plate of a die cutter, a retention member coupled to the axial member, and a biasing member situated along the axial member in an abutting relationship with the retention member and configured to abut a second die plate of the die cutter.

According to another example, ("Example 12") further to Example 11, the axial member is frictionally retained in the first die plate.

According to another example, ("Example 13") further to Example 11, the system further includes a first fastener coupled to the first die plate and including a first threaded portion, the axial member being threadedly engaged with the first fastener.

According to another example, ("Example 14") further to Example 13, the system further includes a second fastener, wherein the first fastener further includes a second threaded portion and wherein the second fastener is threadedly engaged with the first fastener via the second threaded portion.

According to another example, ("Example 15") further to Example 14, the system further includes a die cutter including the first die plate and the second die plate, wherein the second fastener is threadedly engaged with the first fastener such that a portion of the first die plate is situated between the first and second fasteners.

According to another example, ("Example 16") a method includes providing a separation assembly comprising an axial member, a retention member, and a biasing member. The method further includes providing a die cutter having a first die plate and a second die plate, securing the axial member to the first die plate of the die cutter, positioning the second die plate along the axial member such that the axial member extends through a bore of the second die plate and such that the second die plate is in a sliding relationship with the axial member, disposing the biasing member about the axial member, and securing the retention member to the axial member such that the biasing member is situated between the retention member and the second die plate, and such that the biasing member is in an abutting relationship with each of the retention member and the second die plate.

According to another example, ("Example 17") further to Example 16, the method further includes providing a holding and lifting apparatus including a base, a riser coupled to the base, a plurality of stop bars coupled to the riser, and an actuation assembly including a cam element that is rotatable relative to the base. The method further includes positioning the die cutter on the holding and lifting apparatus such that die cutter is supported by the plurality of stop bars and such that the separation assembly is situated adjacent the actuation assembly.

According to another example, ("Example 18") further to Example 17, the separation assembly is situated such that an actuation of the actuation assembly is operable to cause the cam element to displace the axial member and the first die plate.

According to another example, ("Example 19") further to Example 17, the method further includes securing one or more of the first and second die plates between the plurality of stop bars.

According to another example, ("Example 20") further to Example 17, one or more of the axial member, the retention member, and the biasing member of the separation assembly extends into a bore of the riser.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Figure 1:
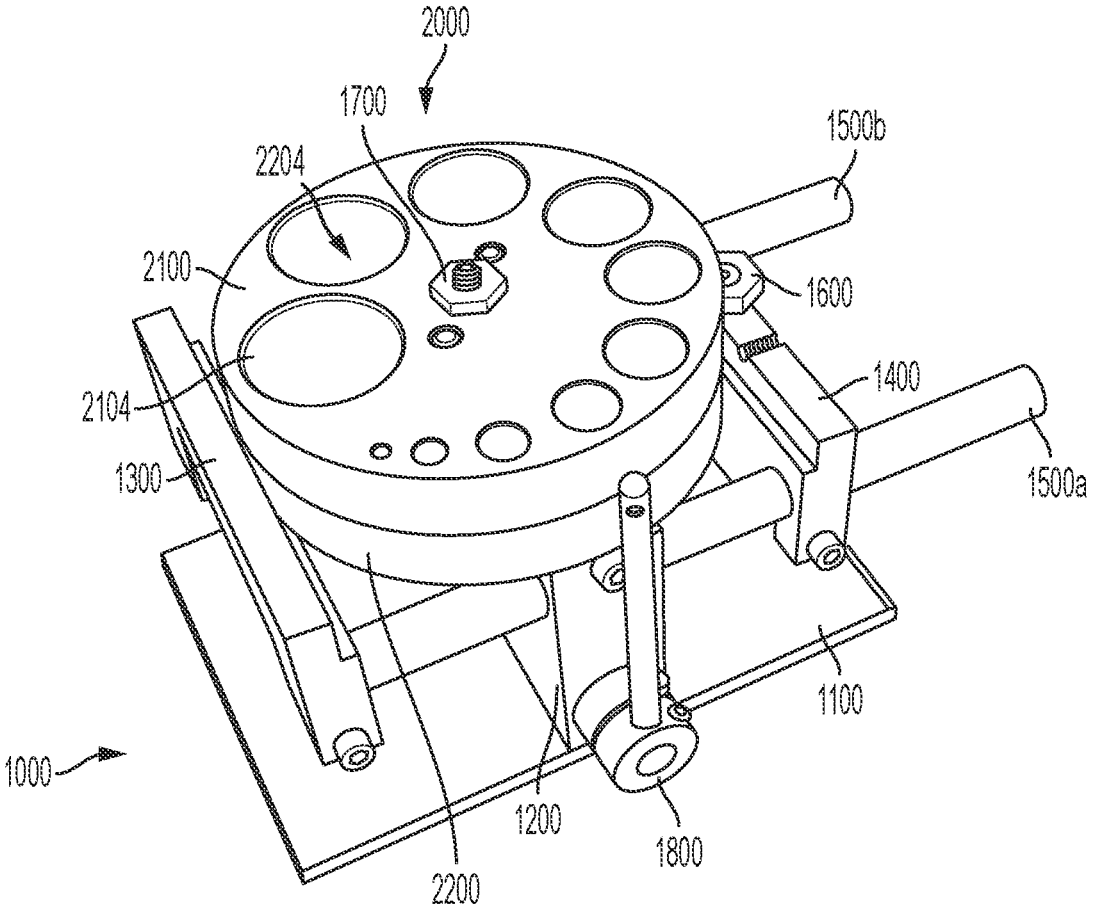
FIG. 1 is a perspective view of a die holding and lifting system in combination with a die cutter, according to some embodiments.

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting. Additionally, it should be understood by those of skill in the art that the inventive scope of the disclosure should not be limited to the particular embodiments discussed herein.

Various aspects of the present disclosure are directed toward systems, devices, and methods for cutting, punching, or stamping metal components for jewelry making. In particular, the present disclosure includes systems, devices, and methods for holding and separating upper and lower die plates of die cutting systems or devices during their operation to facilitate high volume production. In various embodiments, the systems, devices, and methods of the present disclosure facilitate quick temporary separation of the top and bottom die plate of a die cutting system or device that allows material situated between the top and bottom die plates to be advanced between cutting, stamping, or pressing operations without compromising the immobilization of the material being cut, stamped, or pressed during the cutting, stamping, or pressing operation. Thus, in various examples, the systems, devices, and methods of the present disclosure operate to transition a die cutting device between opened and closed configurations, wherein the material being cut, stamped, or pressed is immobilized in the closed configuration and advanceable in the open configuration.

Additionally, as discussed in greater detail below, in addition to use in operations where the cutting component of the die cutter is struck by a mallet, the systems, devices, and methods of the present disclosure can additionally or alternatively be integrated into or otherwise used in accordance with hydraulic, pneumatic, arbor, and other mechanical presses.

FIG. 1 is a perspective view of a system 1000 configured to facilitate the operation of a die cutter 2000. The system 1000 is configured to hold the die cutter 2000 and/or maintain a position of one or more portions of the die cutter 2000 while a cutting, stamping, or pressing operation is executed. In some examples, the system 1000 is additionally configured to facilitate the separation (or lifting) of one or more die plates of the die cutter 2000 such that a material that is situated between plates of the die cutter 2000 can be advanced between cutting, stamping, or pressing operations. It will be appreciated that the system 1000 can be used in association with a material advancement system. That is, in various examples, one or more material advancement systems may be utilized to advance the stock material during the separation (or lifting) of the one or more die plates of the die cutter 2000. In various examples, the material advancement system is timed to automatically advance the material a designated amount upon the separation (or lifting) of the one or more die plates of the die cutter 2000.

In various embodiments, a die cutter generally consists of one or more die plates that include one or more guides or openings into which a punch or forming component can be inserted and driven through a stock piece of material to create a stamping, as those of skill in the art will appreciate. In some embodiments, a die cutter includes a plurality of selectively separable die plates between which the stock piece of material is situated during a cutting, stamping, or pressing operation. For example, die cutter 2000 includes an upper die plate 2100 and a lower die plate 2200. Die cutter 2000 may be any commercially available die cutter.

The upper die plate 2100 is a structural component having a body 2102 and a one or more die cutter guides 2104. The body 2102 has a top 2106, a bottom 2108, and an edge 2110. In various examples, the edge is a continuous edge. For instance, in some examples, the upper die plate 2100 is cylindrical or puck-shaped and edge 2110 is a continuous circumferential edge. However, it will be appreciated that die cutters of varying shapes, sizes, and configurations can be used in accordance with the system 1000 without departing from the spirit or scope of the present application. For instance, in various examples, a die cutter includes an upper die plate that is polygonal. Thus, in various examples, the upper die plate may include an edge that is discontinuous. That is, in some examples, the upper die plate may include a plurality of discrete edges. In some examples, the discrete edges define a perimeter of the upper die plate.

Additionally, as mentioned above, the upper die plate has a top 2106 and a bottom 2108. In various examples, the bottom 2108 is situated opposite the top 2106. In various examples, the upper die plate 2100 includes one or more die cutter guides 2104. In some examples, the one or more die cutter guides 2104 are formed as apertures in the upper die plate 2100. That is, in some examples, the die cutter guides 2104 extend from the top 2106 to the bottom 2108 of the die plate 2100. It will be appreciated that the die cutter guides 2104 are features into which one or more punch or forming components (not shown) can be inserted and driven through a stock piece of material (not shown) to create a stamping. It will also be appreciated that while the die cutter guides 2104 are illustrated as being cylindrical, the die cutter guides may be of any shape and size.

In various examples, similar to the upper die plate 2100, the lower die plate 2200 is a structural component having a body 2202 and a one or more die cutter apertures 2204. The body 2202 has a top 2206, a bottom 2208, and an edge 2210. In various examples, the edge is a continuous edge. For instance, in some examples, the lower die plate 2200 is cylindrical or puck-shaped and edge 2210 is a continuous circumferential edge. However, it will be appreciated that die cutters of varying shapes, sizes, and configurations can be used in accordance with the system 1000 without departing from the spirit or scope of the present application. For instance, in various examples, a die cutter includes a lower die plate that is polygonal. Thus, in various examples, the lower die plate may include an edge that is discontinuous. That is, in some examples, the lower die plate may include a plurality of discrete edges. In some examples, the discrete edges define a perimeter of the lower die plate.

Additionally, as mentioned above, the lower die plate has a top 2206 and a bottom 2208. In various examples, the bottom 2208 is situated opposite the top 2206. In various examples, the lower die plate 2200 includes one or more die cutter apertures 2204. In some examples, the one or more die cutter apertures 2204 are formed as apertures in the lower die plate 2200. That is, in some examples, the die cutter apertures 2204 extend from the top 2206 to the bottom 2208 of the lower die plate 2200. It will be appreciated that while the die cutter apertures 2204 are illustrated as being cylindrical, the die cutter apertures may be of any shape and size.

In various examples, one or more of the upper and lower die plates 2100 and 2200 includes one or more locating elements and/or one or more receiving features configured to accommodate or receive the one or more locating elements. It will be appreciated that such locating elements and receiving features operate to maintain an alignment of the die cutter apertures 2104 and 2204 of the top and bottom die plates 2100 and 2200, respectively. As discussed in greater detail below, such locating elements and receiving features operate to constrain the relative movement between the upper and lower die plates 2100 and 2200 during operation.

In various examples, the system 1000 includes a base 1100, a riser 1200, one or more stop bars, such as first and second stop bars 1300 and 1400, and one or more stop bar rails, such as the first and second stop bar rails 1500*a* and 1500*b*. In some examples, the first and second stop bars 1300 and 1400, and the first and second stop bar rails 1500*a* and 1500*b* operate to position and secure the die cutter 2000 to the base 1100 and/or riser 1200. In some examples, the system 1000 further includes a wedge clamp 1600 that operates as a one of a primary and secondary clamping mechanism for securing or otherwise immobilizing a portion of the die cutter 2000, as discussed in greater detail below.

In various examples, the system 1000 additionally or alternatively includes a separation assembly that facilitates separation of the upper and lower die plates 2100 and 2200 of the die cutter 2000. For example, as shown in FIG. 1, the system 1000 includes a separation assembly 1700. As discussed in greater detail below, the separation assembly 1700 facilitates a quick and repeatable separation of the upper and lower die plates 2100 and 2200. In some examples, such a separation of the upper and lower die plates 2100 and 2200 enables an operator to advance or otherwise rearrange a stock material that is placed between the upper and lower die plates 2100 and 2200 between cutting, stamping, or pressing operations such that an uncut portion of the stock material may be positioned properly for another stamping to be cut, stamped, or pressed therefrom.

Figure 2:
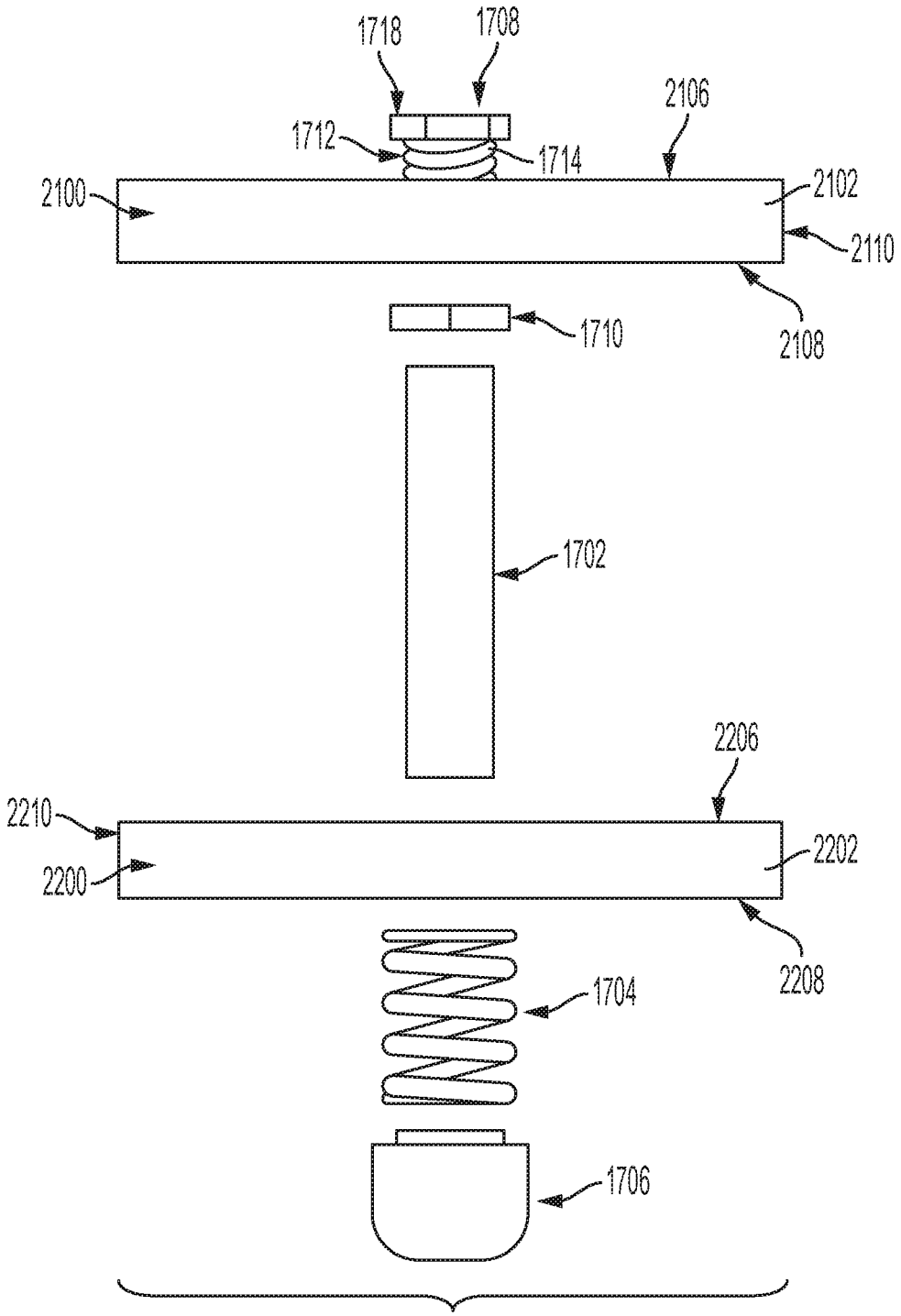
FIG. 2 is an exploded view of a separation assembly in combination with a die cutter, according to some embodiments.
Figure 3:
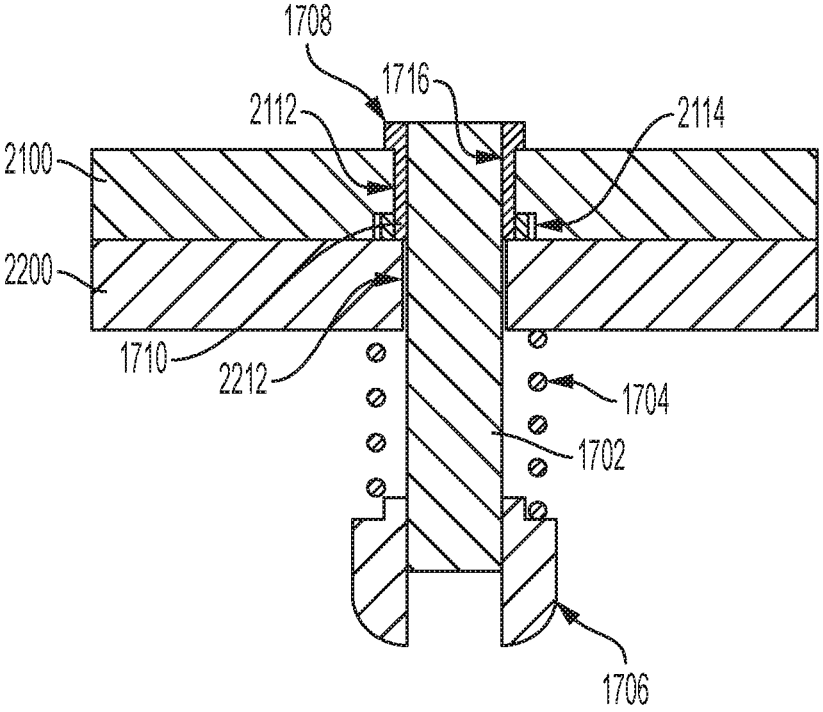
FIG. 3 is a cross section view of a separation assembly in combination with a die cutter, according to some embodiments.

Turning now to FIGS. 2 and 3, an exemplary separation assembly 1700 is shown in combination with the upper and lower die plates 2100 and 2200 of die cutter 2000. FIG. 2 is an exploded view of the exemplary separation assembly 1700 shown in combination with the upper and lower die plates 2100 and 2200. FIG. 3 is a cross-section view of the exemplary separation assembly 1700 shown in combination with the upper and lower die plates 2100 and 2200. In various examples, the separation assembly 1700 includes an axial member 1702, a biasing member 1704, and a retention member 1706. In some examples, the separation assembly 1700 further includes one or more elements for fixedly coupling the axial member 1702 to one of the upper and lower die plates 2100 and 2200. Thus, while the separation assembly 1700 illustrated in the associated figures includes a plurality of fastening members 1708 and 1710 for use in securing the axial member 1702 to one of the upper and lower die plates 2100 and 2200, the separation assembly 1700 is not so limited. In some examples, the fastening member 1710 is a lock nut. Indeed, it will be appreciated that a variety of other means can be implemented to secure the axial member 1702 to one of the upper and lower die plates 2100 and 2200. Nonlimiting examples include welding, threading, pinning, and pressing.

In various examples, the axial member 1702 is an elongate structure. The axial member 1702 may be cylindrical in some examples, and non-cylindrical in others. For example, the axial member 1702 may alternatively be polygonal. In some examples, the axial member 1702 is secured to one of the upper and lower die plates 2100 and 2200 and operates to cause separation of the upper and lower die plates 2100 and 2200. For instance, in various examples, the separation assembly 1700 is configured to receive an input and cause separation of the upper and lower die plates 2100 and 2200 in response to the input. In some examples, the axial member 1702 operates to cause the upper die plate 2100 to separate or otherwise translate away from the lower die plate 2200. In other examples, the axial member 1702 operates to cause the lower die plate 2200 to separate or otherwise translate away from the upper die plate 2100. In other examples, the axial member 1702 operates to cause the upper and lower die plates 2100 and 2200 to separate or otherwise translate away from one another.

In various examples, as mentioned above, the axial member 1702 is coupled or, alternatively, coupleable (e.g., removably coupled) to one of the upper and lower die plates 2100 and 2200. Generally, when coupled to the upper die plate 2100, the axial member 1702 is constrained against movement (e.g., rotationally or translationally) relative to the upper die plate 2100, yet remains free to move (e.g., rotationally or translationally) relative to the lower die plate 2200. Likewise, when coupled to the lower die plate 2200, the axial member 1702 is constrained against movement (e.g., rotationally or translationally) relative to the lower die plate 2200, yet remains free to move (e.g., rotationally or translationally) relative to the upper die plate 2100.

Those of skill in the art should appreciate that the axial member 1702 is coupleable to one of the upper and lower die plates 2100 and 2200 in a variety of different manners. For instance, in some examples, the axial member 1702 is threaded into one of the upper and lower die plates 2100 and 2200. In some examples, the axial member 1702 is welded to one of the upper and lower die plates 2100 and 2200. In some examples, the axial member is pressed into an aperture of (and thus frictionally retained by) one of the upper and lower die plates 2100 and 2200. In some examples, alternative to or in addition to such a mechanical coupling, one or more fasteners may be utilized to couple the axil member to one of the upper and lower die plates 2100 and 2200. For example, as shown in FIGS. 2 and 3, the separation assembly includes a fastening member 1708 and a lock nut 1710. In some example, the fastening member 1708 is a cap nut. In various example, the fastening member 1708 and lock nut 1710 are positioned within a central bore of the upper die plate 2100 and provide an anchoring mechanism for coupling the axial member 1702 to the upper die plate 2100. In this illustrated example, the axial member 1702 is a threaded rod and the fastening member 1708 and lock nut 1710 assembly has a central threaded bore into which the axial member 1702 can be threaded. Those of skill in the art should appreciate that one or more of the fastening member 1708, the lock nut 1710, and the axial member 1702 may be integral with one another. That is, in some examples, one or more of the fastening member 1708, the lock nut 1710, and the axial member 1702 may form a single monolithic or inseparable component.

As mentioned above, in various examples, the separation assembly includes a biasing member 1704 and a retention member 1706. The biasing member 1704 and the retention member 1706 help facilitate the quick and repeatable separation of the upper and lower die plates 2100 and 2200 during the cutting, stamping, or pressing operation. The biasing member 1704 is generally a resilient member (e.g., a spring or other component) that is deformable (e.g., compressible and/or extendable) and capable of exerting a force that influences one or more of the upper and lower die plates 2100 and 2200 to immobilize or release material being punched (e.g., see FIG. 4 where the upper and lower die plates 2100 and 2200 are separated from one another to the extent that a metal stock from which stamping are being formed can be rearranged), or a closed or collapsed configuration (e.g., see FIG. 5 where the upper and lower die plates 2100 and 2200 sandwich and effectively immobilize the metal stock situated therebetween).

In various examples, the biasing member 1704 is situated adjacent to and exerts a force on at least one of the upper and lower die plates 2100 and 2200. In some examples, the biasing member 1704 is disposed about the axial member 1702. For example, as shown in FIGS. 3 to 5, the biasing member 1704 is disposed about the axial member 1702 and is situated therealong such that the axial member 1702 extends through an interior of the biasing member 1704, and such that the biasing member 1704 is positioned adjacent the lower die plate 2200.

Figure 4:
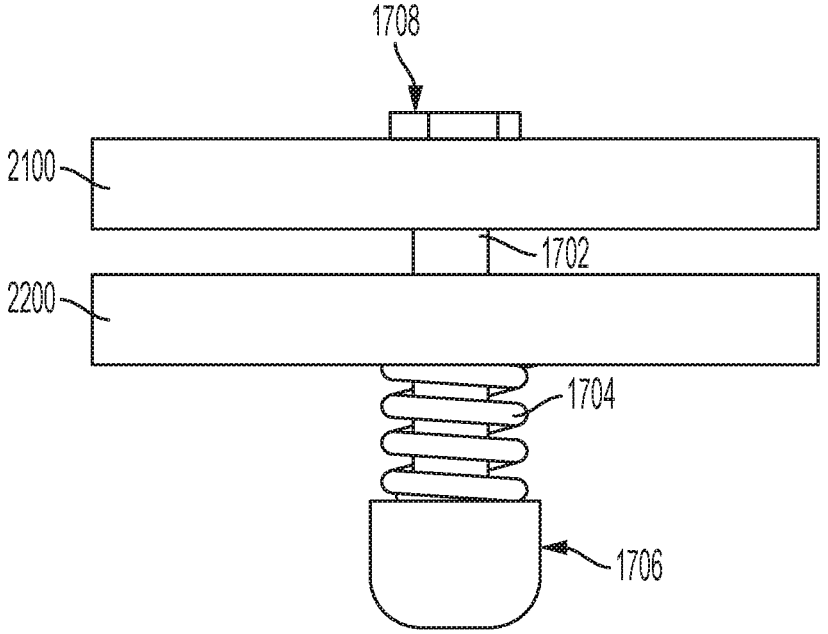
FIG. 4 is a front view of a separation assembly in combination with a die cutter in a closed configuration, according to some embodiments.
Figure 5:
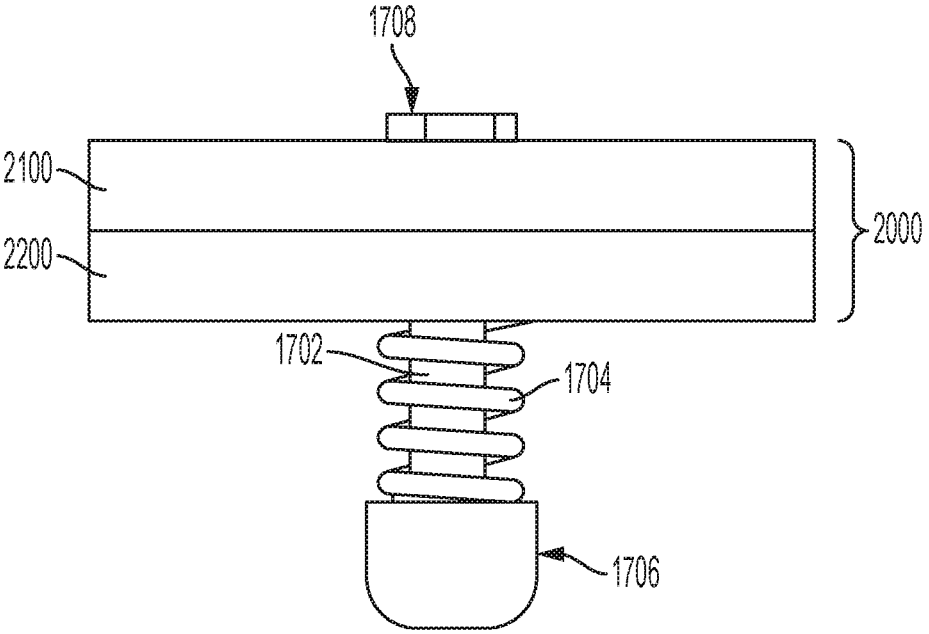
FIG. 5 is a front view of a separation assembly in combination with a die cutter in an open configuration, according to some embodiments.

In the illustrated examples of FIGS. 3 to 5, the biasing member 1704 is positioned between the retention member 1706 and the lower die plate 2200. In various examples, the retention member 1706 interfaces with the axial member 1702 to retain the biasing member 1704 along the axial member 1702 and provide tension adjustment. In some examples, the retention member 1706 includes a threaded bore and is threaded onto the axial member 1702. In some examples, the retention member 1706 is pressed, welded, or otherwise frictionally retained by the axial member 1702. In some examples, the axial member 1702 and the retention member 1706 are one-and-the same. That is, in some examples, the axial member 1702 and the retention member 1706 form a single monolithic unit or component. In some such examples, the axial member 1702 and the retention member 1706 may be machined, welded, joined, or otherwise formed via any suitable process or procedure as those of skill should appreciate. It should also be appreciated that where the axial member 1702 and the retention member 1706 form an inseparable unit, the axial member 1702 is generally separable or removably coupleable to one or more of the fastening members 1708 and 1710 such that the separation assembly 1700 can be deconstructed from the die cutter 2000 and replaced, repaired, cleaned. In various examples, such a construction also facilitates additionally or alternatively reassembling the separation assembly in conjunction with a different die cutter (e.g., made by any manufacturer). Thus, those of skill in the art should appreciate that the separation assembly is universal in nature and can be adapted to interface with virtually any die cutter. Alternatively, the separation assembly may be configured for use with only a single make/model of die cutter or a limited number of die cutters (e.g., of a particular brand or of a particular size and/or shape).

In some examples, the retention member 1706 operates as a reaction mechanism against which the biasing member 1704 can exert force. Specifically, as one or more of the upper and lower die plates 2100 and 2200 are actuated (e.g., translated along the axial member) relative to the other of the upper and lower die plates 2100 and 2200, the biasing member 1704 is compressed. In some such examples, biasing member 1704 is compressed between one of the upper and lower die plates 2100 and 2200 and the retention member 1706. Providing such a mechanism provides that the biasing member 1704 can exert a force the upper or lower die plate 2100 and 2200 in a manner that influence the upper or lower die plate 2100 or 2200 to translate away from the biasing member 1704. In various examples, such a configuration operates to facilitate repetitious and efficient opening and closing of the die cutter 2000. It will be appreciated that while the illustrated examples include a single biasing member situated between the retention member 1706 and the lower die plate 2200, some other examples include a biasing member situated between the upper die plate 2100 and an end of the axial member 1702 adjacent the upper die plate 2100, and/or a biasing member situated between the upper and lower die plates 2100 and 2200. Additionally or alternatively, as discussed further below, the separation assembly 1700 may include a plurality of biasing members situated between a plurality of the components of the separation assembly 1700. Thus, it will be appreciated that the inventive scope of the present application is not limited to a single biasing member situated between the retention member 1706 and the lower die plate 2200.

In various examples, the biasing member 1704 exerts a force on the lower die plate 2200 that influences the lower die plate 2200 toward the upper die plate 2100. In particular, as shown in FIG. 3, the axial member 1702 is secured to the upper die plate 2100 and extends through the lower die plate 2200 such that the axial member is operable to translate relative to the lower die plate 2200. In some examples, the axial member 1702 extends through a bore in the lower die plate 2200. Such a configuration provides that the axial member 1702 is constrained against translation relative to the upper die plate 2100 while remaining free to move relative to the lower die plate 2200. As shown, the retention member 1706 is coupled to the axial member 1702 such that the lower die plate 2200 is positioned between the retention member 1706 and the upper die plate 2100, and such that the biasing member 1704 is disposed about the axial member 1702 between the retention member 1706 and a bottom 2208 of the lower die plate 2200.

FIG. 5 shows the separation assembly 1700 in conjunction with the upper and lower die plates 2100 and 2200 in a closed or collapsed configuration. FIG. 4 shows the separation assembly 1700 in conjunction with the upper and lower die plates 2100 and 2200 in a separated or open configuration. As discussed in greater detail below, the system 1000 facilitates a transition of the upper and lower die plates 2100 and 2200 between the open and closed configurations. In various examples, in the open or separated configuration, the upper and lower die plates 2100 and 2200 have been translated away from one another. In various examples, in the open configuration, the biasing member 1704 is compressed between the bottom 2208 of the lower die plate 2200 and the retention member 1706. This compression causes energy to be stored in the biasing member 1704, which in turn causes a force to be exerted by the biasing member 1704 on the bottom 2208 of the lower die plate 2200 in a direction away from the retention member 1706. This compression also causes a force to be exerted by the biasing member 1704 on the retention member 1706 in a direction away from the lower die plate 2200. The combination of these forces on the lower die plate 2200 and the retention member 1706 influence the lower die plate 2200 and the retention member 1706 away from one another.

In various examples, the biasing member 1704 is compressed an amount that corresponds to an amount of separation achieved between the upper and lower die plates 2100 and 2200. For example, if the upper and lower die plates 2100 and 2200 are separated by one half of an inch (0.5 in), then the biasing member 1704 is compressed such that its axial length is reduced by one half of an inch (0.5 in). Likewise, if the upper and lower die plates 2100 and 2200 are separated by one inch (1.0 in), then the biasing member 1704 is compressed such that its axial length is reduced by one inch (1.0 in). In various examples, the amount by which the upper and lower die plates 2100 and 2200 are separated depends on a number of factors and can be modified as desired to virtually any amount as those of skill will appreciate.

Additionally, in various examples, as discussed in greater detail below, when the force exerted on the separation assembly 1700 that causes the displacement of the upper and lower die plates 2100 and 2200 relative to one another is removed, the energy stored in the compressed biasing member 1704 causes the upper and lower die plates 2100 and 2200 to translate toward one another. In some examples, the upper and lower die plates 2100 and 2200 translate toward one another until they come into contact with each other or until they contact an element (e.g., stock material) situated therebetween.

As mentioned above, when positioned in the closed or collapsed stated, the stock material situated between the upper and lower die plates 2100 and 2200 is immobilized. In various examples, this immobilization is facilitated by the upper and lower die plates 2100 and 2200 being forced toward one another in the closed configuration and the stock material being frictionally retained therebetween. Thus, it will be appreciated that in some examples, while the biasing member 1704 exerts a force on one of the upper and lower die plates 2100 and 2200 in the open configuration (e.g., FIG. 4), the biasing member 1704 likewise exerts a force on one of the upper and lower die plates 2100 and 2200 in the closed configuration (e.g., FIG. 5) that influences the upper and lower die plates 2100 and 2200 toward one another. In some examples, a same or similar force is exerted on by the biasing member 1704 in both the open and closed configurations. In some other examples, a greater force (or alternatively, a smaller force) is exerted by the biasing member 1704 in the open configuration than in the closed configuration.

In various other examples, the stock material may be additionally or alternatively immobilized via the utilization of one or more additional mechanisms that press or squeeze the upper and lower die plates 2100 and 2200 together during the cutting, stamping, or pressing operation. For example, one or more clamps or other mechanical mechanisms may be utilized to squeeze the upper and lower die plates 2100 and 2200 together. In some examples, the clamps are configured to decouple or otherwise cease their application of force to the upper and lower die plates 2100 and 2200 upon actuation of the separation assembly As mentioned above, in various examples, one or more biasing members may additionally or alternatively be positioned between the upper die plate 2100 and an end of the axial member situated adjacent the upper die plate 2100. For instance, in some examples, a portion or an end of the axial member 1702 may extend above the top 2106 of the upper die plate 2100 and a biasing member may be positioned between the end of the axial member and the top 2106 of the upper die plate 2100. In some such examples, in a manner similar to that discussed above with respect to a biasing member 1704 being positioned between the retention member 1706 and the lower die plate 2200, a biasing member may be positioned between the top 2106 of the upper die plate 2100 and one or more elements coupled to the end of the axial member 1702 extending above the top 2106 of the upper die plate 2100. Thus, in a manner similar to that discussed above with respect to the biasing member 1704 influencing the lower die plate 2200 toward the upper die plate 2100, a biasing member situated between the top 2106 of the upper die plate 2100 and one or more elements coupled to the end of the axial member 1702 extending above the top 2106 of the upper die plate 2100 may operate to influence the upper die plate 2100 toward the lower die plate 2200 and away from and end of the axial member 1702 extending above the top 2106 of the upper die plate 2100.

Moreover, while the above-discussed examples include a biasing member that is configured to influence the upper and lower die plates 2100 and 2200 toward one another, in various alternative embodiments, a separation assembly is configured such that the biasing member 1704 influences the upper and lower die plates 2100 and 2200 away from one another. Such a separation assembly is generally similar to the separation assembly 1700 discussed above, with an exception being that the biasing member 1704 is positioned between the upper and lower die plates 2100 and 2200. Such a configuration provides that the biasing member 1704 exerts a force on the upper and lower die plates 2100 and 2200 that influences the upper and lower die plates 2100 and 2200 away from one another. In some such examples, the biasing member 1704 is situated between the top 2206 of the lower die plate 2200 and the bottom 2108 of the upper die plate 2100. It will be appreciated that tendency of the separation assembly 1700 to influence the upper and lower die plates 2100 and 2200 away from one another requires that during cutting, punching, and/or pressing operations, the bias of the separation assembly 1700 is mechanically overcome by drawing the upper and lower die plates 2100 and 2200 toward one another in a manner that operates to sandwich and frictionally retain the stock material between the upper and lower die plates 2100 and 2200. It will also be appreciated that such a configuration provides for the ability to vary the clamping force, and thus the degree of frictional retention of the stock material situated between the upper and lower die plates 2100 and 2200.

In various examples, the ability to cause a separation and/or drawing together of the upper and lower die plates 2100 and 2200 is facilitated by both the separation assembly 1700 the various other components of the system 1000. For example, referring back now to the nonlimiting example of FIG. 1, the system 1000 includes an apparatus for holding and supporting the die cutter 2000 while the upper and lower die plates 2100 and 2200 are transitioned between the open and closed configurations. In various examples, the system 1000 includes one or more subassemblies that operate to fix one or more of the upper and lower die plates 2100 and 2200 relative to a base 1100. The base 1100 is generally a structural component to which a riser 1200 is mounted or otherwise coupled. In some examples, the base 1100 includes a protective or compliant pad on an upper surface thereof. In various examples, this protective pad protects against dulling the die cutting members as they are forced through the die cutter 2000 during the cutting, pressing, or stamping procedure.

The riser 1200 may be coupled to the base 1100 at any suitable position and via any suitable means including but not limited to welding, clamping, and/or securing via one or more fasteners or other mechanical means. As shown in FIG. 1, first and second stop bars 1300 and 1400, and the first and second stop bar rails 1500*a* and 1500*b* secure the die cutter 2000 to the base 1100 and/or riser 1200. Specifically, as shown, the lower die plate 2200 is secured between the first and second stop bars 1300 and 1400, which are coupled to the riser 1200 via the first and second stop bar rails 1500*a* and 1500*b*. As discussed further below, in various examples, the positions of the first and second stop bars 1300 and 1400 are independently adjustable along the first and second stop bar rails 1500*a* and 1500*b*. Likewise, the positions of the first and second stop bar rails 1500*a* and 1500*b* are independently adjustable relative to the riser 1200. It will be appreciated that such adjustability provides to a universal system 1000 that can accommodate a die cutter of virtually any shape or size (e.g., any available make or model). In other words, the system 1000 is not specific to a die cutter of a particular brand or model.

Figure 6A:
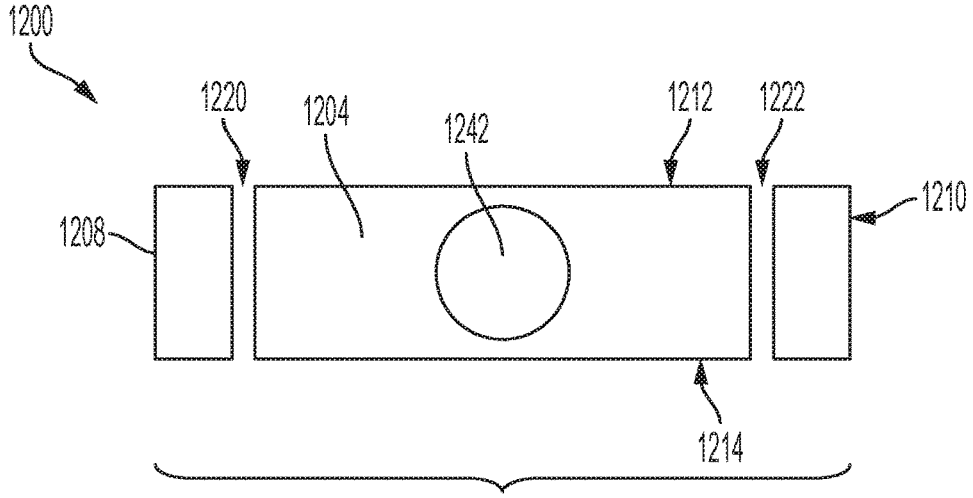
FIG. 6A is a top view of a riser, according to some embodiments.
Figure 6B:
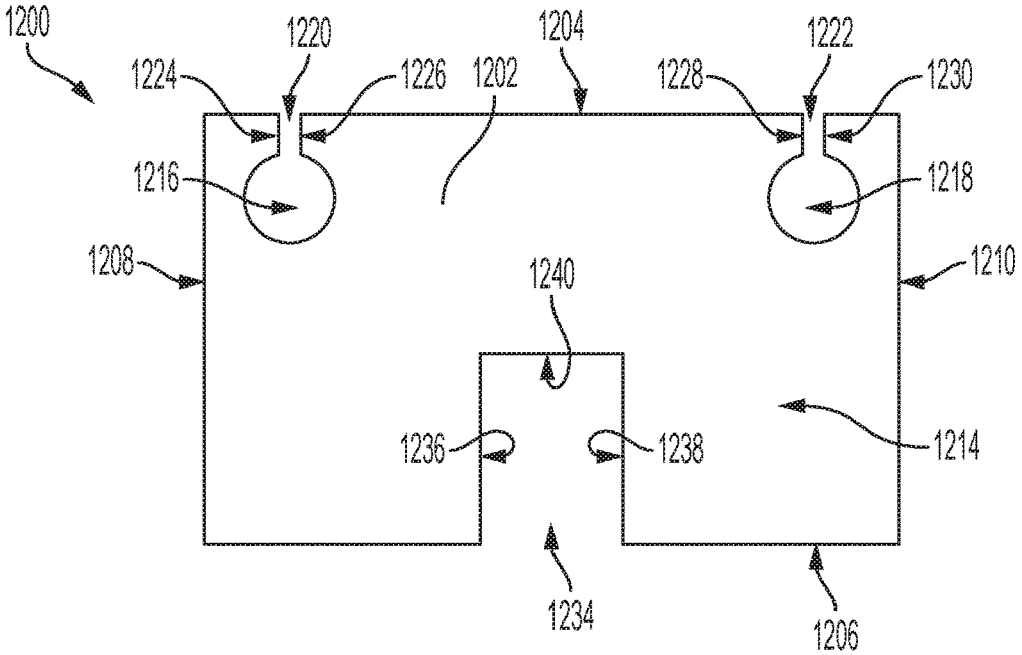
FIG. 6B is a front view of a riser, according to some embodiments.
Figure 6C:
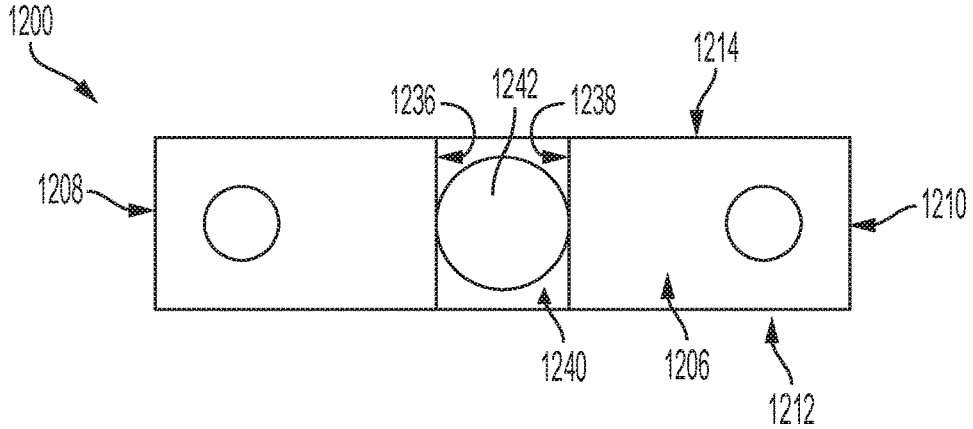
FIG. 6C is a bottom view of a riser, according to some embodiments.
Figure 6D:
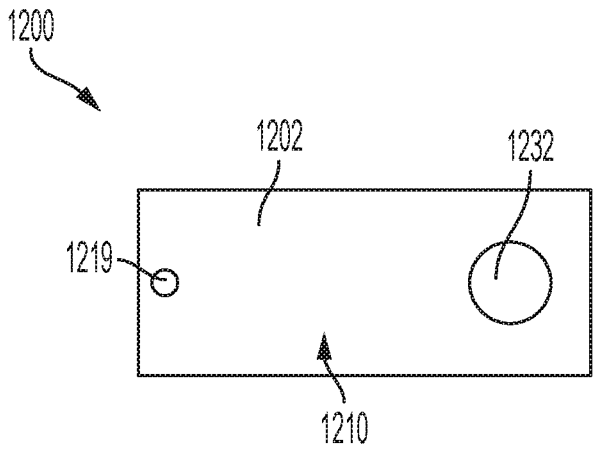
FIG. 6D is a side view of a riser, according to some embodiments.

Turning now to FIGS. 6A-6C, an exemplary riser 1200 is shown. FIG. 6A is a top view of the riser 1200. FIG. 6B is a front view of the riser 1200. FIG. 6C is a bottom view of the riser 1200. FIG. 6D is a side view of the riser 1200. In various examples, the riser 1200 includes a body 1202, a top 1204, a bottom 1206, a first side 1208, a second side 1210, a first face 1212, and a second face 1214. In some examples, the riser 1200 further includes one or more features configured to accommodate and retain the stop bar rails. In various examples, such features include one or more apertures or bores sized to accommodate the stop bar rails. For example, as shown in FIG. 6B, the riser 1200 includes a first stop bar rail accommodation feature 1216 and a second stop bar rail accommodation feature 1218. In various examples, the stop bar rail accommodation features include apertures that extend through the riser 1200 from the first face 1212 to the second face 1214. That is, in various examples, the features of the riser 1200 configured to accommodate the stop bar rails are configured such that the stop bar rails can extend partially and/or entirely through the riser 1200.

In some examples, the stop bar rail accommodation features provide that a position of the stop bar rails can be adjusted relative to the riser 1200. That is, in various examples, a stop bar rail can be received within one of the stop bar rail accommodation features such that the stop bar rail is positioned in a first position relative to the riser 1200 (e.g., a first end of the stop bar rail is first distance from the first face of the riser 1200). In these examples, the stop bar rail can be adjusted or moved relative to the riser such that the stop bar rail is positioned in a second, different position relative to the riser 1200 (e.g., the first end of the stop bar rail is a second distance from the first face of the riser 1200). As discussed in greater detail below, such adjustability provides for a versatile system 1000 that can accommodate, retain, and actuate virtually any off-the-shelf or custom die cutter.

In various examples, the riser 1200 includes one or more features that operate to secure the stop bar rail within the stop bar rail accommodation feature. In some examples, one or more set screws may be threaded into an through a portion of the riser 1200 until they come into contact with the stop bar rail as will be appreciated by those of skill in the art. For example, as shown in FIG. 6D, the riser 1200 includes an aperture 1219 that extends transverse to a longitudinal axis of the stop bar rail accommodation feature. In some examples, the aperture 1219 extends from the second side 1210 through the riser 1200 to the stop bar rail accommodation feature to form a bore that is operable to receive set screw. In various examples, the bore is threaded such that the set screw can be received therein and extended therethrough to engage a stop bar rail received within the stop bar rail accommodation feature, as those of skill will appreciate. Additionally or alternatively, in some examples, a relief is made in a portion of the riser 1200 that provides for the ability to collapse or partially collapse, together or separately, the stop bar rail accommodation features. For example, as shown in FIGS. 6A and 6B reliefs 1220 and 1222 are formed in the riser 1200 and extend from the top 1204 of the riser 1200 to the stop bar rail accommodation features 1216 and 1218. That is, as shown in FIGS. 6A and 6B, the reliefs formed in the riser 1200 expose the apertures of the stop bar rail accommodation features to the top 1204 of the riser. It will be appreciated that the reliefs may alternatively be formed in the riser such that the apertures of the stop bar rail accommodation features are exposed to a side of the riser 1200. In various examples, the incorporation of reliefs 1220 and 1222 into the riser 1200 create opposing surfaces of the riser 1200 that can be drawn together in operation. Specifically, the incorporation of relief 1220 into the riser 1200 creates opposing surfaces 1224 and 1226. Similarly, the incorporation of relief 1222 into the riser 1200 creates opposing surfaces 1228 and 1230.

As those of skill in the art will appreciate, in operation, surfaces 1224 and 1226 can be drawn together to collapse or partially collapse stop bar rail accommodation feature 1216. Likewise, in operation, surfaces 1228 and 1230 can be drawn together to collapse or partially collapse stop bar rail accommodation feature 1218. The collapse or partial collapse of the stop bar rail accommodation features generally includes a reduction in cross section of the stop bar rail accommodation features. For example, as the opposing surfaces 1224 and 1226 are drawn together, a cross section of the aperture of stop bar rail accommodation feature 1216 is reduced such that the diameter of the aperture is reduced. In various examples, the opposing surfaces are drawn together via a fastener, such as a screw. In some examples, the aperture 1219, referred to above, extends between the second side 1210 and opposing surface 1230, and further extends into opposing surface 1228 to form a bore. In these examples, the bore is threaded such that a screw extending from the second side 1210 can be threaded into the bore. In some examples, the portion of the aperture or bore extending from the second side 1210 to the opposing surface 1230 is generally oversized relative to the screw (and otherwise not threaded), as those of skill in the art will appreciate.

In some examples, when a stop bar rail is received within the stop bar rail accommodation feature, a reduction in cross section of the stop bar rail accommodation feature generally results in a frictional interference between the walls of the stop bar rail accommodation feature and the portion of the exterior surface of the stop bar rail received within the stop bar rail accommodation feature. This interference operates to frictionally retain the stop bar rail within the stop bar rail accommodation feature. In some examples, this interference operates to constrain the stop bar rail against movement relative to the riser 1200. Those of skill will appreciate that the drawing together of opposing surfaces 1228 and 1230 operates to reduce the cross section of stop bar rail accommodation feature 1218 in a similar manner.

Figure 7A:
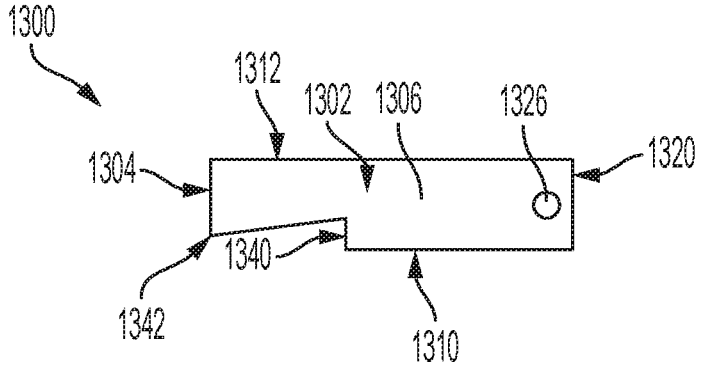
FIG. 7A is a side view of a riser, according to some embodiments.
Figure 7B:
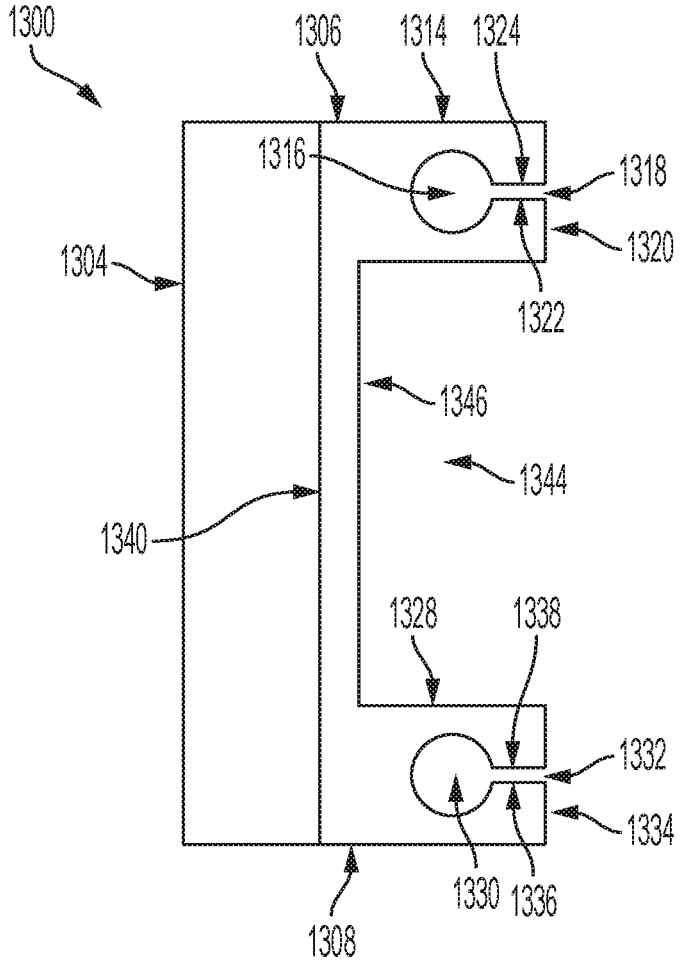
FIG. 7B is a front view of a riser, according to some embodiments.

Turning now to FIGS. 7A and 7B, an exemplary first stop bar 1300 is shown. FIG. 7A is a side view of the first stop bar 1300. FIG. 7B is a front view of the first stop bar 1300. In various examples, the first stop bar 1300 includes a body 1302, a top 1304, a first side 1306, a second side 1308, a front 1310, and a back 1312. In various examples, the first stop bar 1300 includes one or more features configured to facilitate a coupling between the first stop bar 1300 and one or more of the stop bar rails, such as stop bar rails 1500*a* and 1500*b*. For example, as shown in FIG. 7B, the first stop bar 1300 includes a first stop bar rail interface feature 1314. In some examples, the first stop bar rail interface feature 1314 is a projection that includes features similar to those discussed above in relation to the riser 1200 that facilitate a coupling between the riser 1200 and the stop bar rails. For example, the stop bar rail interface feature 1314 includes an aperture or bore 1316 similar to the first and second stop bar rail accommodation features 1216 and 1218 that is configured to accommodate a stop bar rail therethrough. In various examples, the aperture or bore 1316 extends from the front 1310 to the back 1312 of the first stop bar 1300.

In some examples, similar to the reliefs 1220 and 1222, a relief 1318 is formed in a bottom surface 1320 of the stop bar rail interface feature 1314 that extends from the bottom surface 1320 to the aperture 1316. Likewise, similar to the reliefs 1220 and 1222, the relief 1318 creates two opposing surfaces 1322 and 1324 that can be drawn together to frictionally retain a stop bar rail within the aperture 1316 and thereby constrain the first stop bar 1300 against movement relative to the stop bar rail. In various examples, as similarly discussed above with respect to the aperture 1219 of the riser 1200, the stop bar rail interface feature 1314 includes one or more features that operate in combination with one or more set screws to secure the stop bar rail within the stop bar accommodation feature. Specifically, in some examples, the stop bar rail interface feature 1314 includes an aperture or bore 1326 that extends from the first side 1306 to either of the interior surface of the aperture 1316 or the opposing surface 1324. That is, the aperture or bore 1326 extends transverse to a longitudinal axis of the aperture 1316. As similarly discussed above with respect to the aperture 1219 of the riser 1200, a set screw may be threaded into or through the bore to either engage a stop bar rail received within the aperture 1316 or to engage a threaded portion of the bore extending into opposing surface 1322 to facilitate the drawing together of surfaces 1322 and 1324, as those of skill will appreciate.

The first stop bar 1300 is shown in FIG. 7B as including a plurality of stop bar rail interface features. For example, in addition to the stop bar rail interface feature 1314, the first stop bar 1300 includes a second stop bar rail interface feature 1328. Those of skill should appreciate that the second stop bar rail interface feature 1328 is similar to the first stop bar rail interface feature 1314, and includes at least an aperture 1330, a bottom surface 1334, and one or more features, such as one or more apertures or bores (not illustrated), extending from the second side surface 1308 into the stop bar rail interface feature 1328 that operate in combination with one or more set screws to secure the stop bar rail within the stop bar accommodation feature 1328. In some examples, the stop bar rail interface feature 1328 further includes a relief 1332 (similar to relief 1318) that creates opposing side surfaces 1336 and 1338 (similar to opposing side surfaces 1322 and 1324), that can be drawn together to secure a stop bar rail within the aperture 1330.

As mentioned above and as discussed in greater detail below the system 1000 is configured to interface with the die cutter 2000. In various examples, the system 1000 includes one or more features that interface with the die cutter 2000 and retain the die cutter 2000 such that one or more cutting, stamping, or pressing operations can be carried out. In some examples, the die cutter 2000 is retained by the first stop bar 1300. That is, in various examples, the first stop bar 1300 includes one or more features that are configured to interface with the die cutter 2000. For example, as shown in FIGS. 7A and 7B, the first stop bar 1300 includes a flange 1340. In various examples, the flange 1340 is configured to support and secure the die cutter 2000. In other words, in various examples, the flange 1340 is configured to support a top or bottom of one of the upper or lower die plates 2100 and 2200 of the die cutter 2000. In various examples, the flange 1340 is situated between the top 1304 and the bottom surfaces 1320 and 1334 of the stop bar rail interface features 1314 and 1328, respectively. That is, in some examples, the flange is situated below the top 1304 and above the bottom of the first stop bar 1300. In some examples, the flange is formed by a portion of the front 1310 being recessed. In some examples, a surface or face extending between the flange 1340 and the top 1304 is angled relative to one or more of the flange 1340 and the top 1304, and is recessed or otherwise offset relative to the front 1310. In various examples, such an angled surface provides for controlled engagement with an exterior edge of one of the upper and lower die plates 2100 and 2200 of the die cutter 2000. For instance, in some examples, such an angled surface provides that an edge 1342 formed between the top 1304 and the surface extending between the top 1304 and the flange 1340 engages one of the upper and lower die plates 2100 and 2200. As discussed in greater detail below, in some examples, such a configuration also provides that the first stop bar 1300 applies a force on one of the upper and lower die plates 2100 and 2200 in a direction toward the flange 1340, which helps maintain a position and angle of the die cutter relative to certain of the components of the system 1000 during the cutting, punching, and/or pressing operations.

Figure 8A:
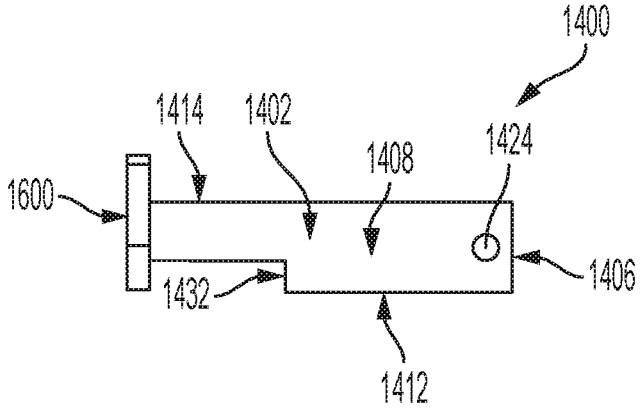
FIG. 8A is a side view of a riser, according to some embodiments.
Figure 8B:
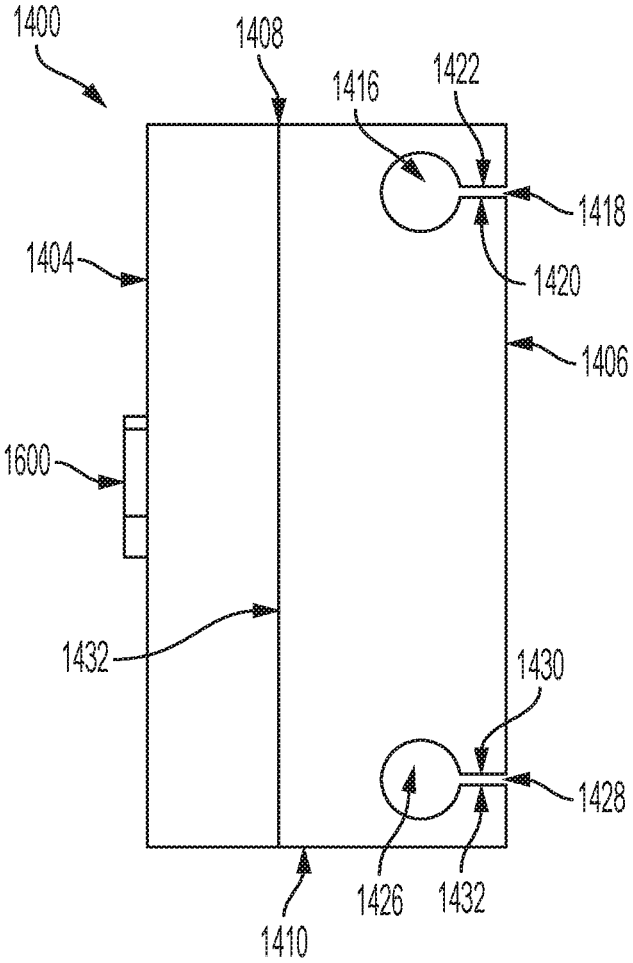
FIG. 8B is a front view of a riser, according to some embodiments.
Figure 8C:
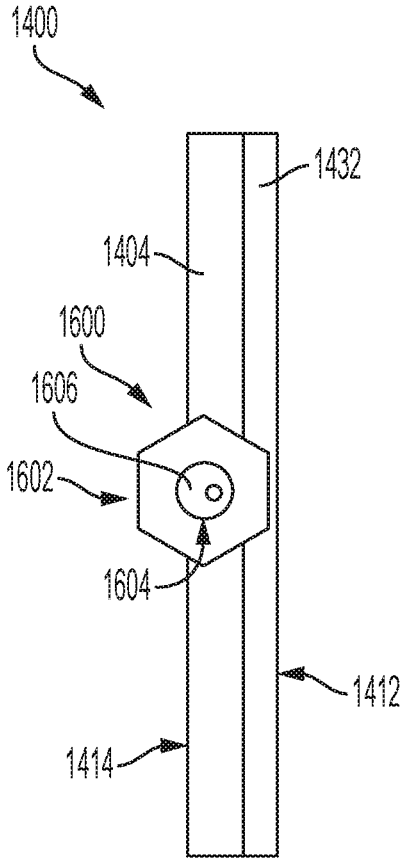
FIG. 8C is a top view of a riser, according to some embodiments.

As mentioned above, in addition to the first stop bar, in various examples, the system 1000 includes a second stop bar 1400. In some examples, the first and second stop bars 1300 and 1400 operate to maintain a position of the die cutter 2000 relative to certain of the components of the system 1000. Turning now to FIGS. 8A and 8C, an exemplary second stop bar 1400 is shown. FIG. 8A is a side view of the second stop bar 1400. FIG. 8B is a front view of the second stop bar 1400. FIG. 8C is a top view of the second stop bar 1400. In various examples, the second stop bar 1400 includes a body 1402, a top 1404, a bottom 1406, a first side 1408, a second side 1410, a front 1412, and a back 1414. Like the first stop bar 1300, in various examples, the second stop bar 1400 includes one or more features configured to facilitate a coupling between the second stop bar 1400 and one or more of the stop bar rails, such as stop bar rails 1500*a* and 1500*b*. For example, as shown in FIG. 8B, the second stop bar 1400 includes an aperture or bore 1416 similar to aperture 1316 that is configured to accommodate a stop bar rail therethrough or otherwise receive a stop bar rail therein. In various examples, the aperture or bore 1416 extends from the front 1412 to the back 1414 of the second stop bar 1400.

In some examples, similar to the relief 1318, a relief 1418 is formed in the bottom 1406 of the second stop bar 1400. In various examples, the relief 1418 extends from the bottom 1406 to at least the aperture 1416. Likewise, similar to the relief 1318, the relief 1418 creates two opposing surfaces 1420 and 1422 that can be drawn together to frictionally retain a stop bar rail within the aperture 1416 and thereby constrain the second stop bar 1400 against movement relative to the stop bar rail (and vice versa). In various examples, as similarly discussed above with respect to the aperture 1316, the second stop bar 1400 includes one or more features that operate in combination with one or more set screws to secure a stop bar rail within the aperture 1416. Specifically, in some examples, the second stop bar 1400 includes an aperture or bore 1424 that extends from the first side 1408 to either of the interior surface of the aperture 1416 or the opposing surface 1422. That is, the aperture or bore 1424 extends transverse to a longitudinal axis of the aperture 1416. As similarly discussed above with respect to the relief 1318, a set screw may be threaded into or through the bore to either engage a stop bar rail received within the aperture 1416 or to engage a threaded portion of the bore extending into opposing surface 1420 to facilitate the drawing together of surfaces 1420 and 1422, as those of skill will appreciate.

The second stop bar 1400 is shown in FIG. 8B as including a plurality of apertures configured to accommodate a stop bar rail. For example, in addition to aperture 1416, the second stop bar 1400 includes a second aperture 1426. In various examples, the second aperture 1426 is closer in proximity to the second side 1410 than is the first aperture 1416. Those of skill should appreciate that the second aperture 1426 is similar to the first aperture 1416 in both configuration and function. Thus, as those of skill will appreciate, the second aperture operates to interface with a second stop bar rail. In some examples, one or more set screws may be utilized to secure the stop bar rail within the second aperture 1426 in a manner similar to that discussed above. For instance, in addition or alternative to a bore extending into the aperture 1426, the second stop bar 1400 further includes a relief 1428 (similar to relief 1418) that creates opposing side surfaces 1430 and 1432 (similar to opposing side surfaces 1420 and 1422), that can be drawn together to secure a stop bar rail within the aperture 1426.

In some examples, like the first stop bar 1300 mentioned above, the die cutter 2000 is additionally or alternatively retained by the second stop bar 1400. That is, in various examples, the second stop bar 1400 includes one or more features that are configured to interface with the die cutter 2000. For example, as shown in FIGS. 8A-8C, the second stop bar 1400 includes a flange 1432. In various examples, the flange 1432 is configured to support the die cutter 2000. In other words, in various examples, the flange 1440 is configured to support a top or bottom of one or the upper and lower die plates 2100 and 2200 of the die cutter 2000. In various examples, the flange 1432 is situated between the top 1404 and the bottom 1406 of the second stop bar 1400. That is, in some examples, the flange 1432 is situated below the top 1404 and above the bottom 1406 of the second stop bar 1400. In some examples, the flange is formed by a portion of the front 1412 being recessed such that a surface or face extending between the flange 1432 and the top 1404 is recessed or otherwise offset relative to the front 1412. This recess allows for the die cutter 2000 to be supported by the flange 1432 of the second stop bar 1400.

Figure 9:
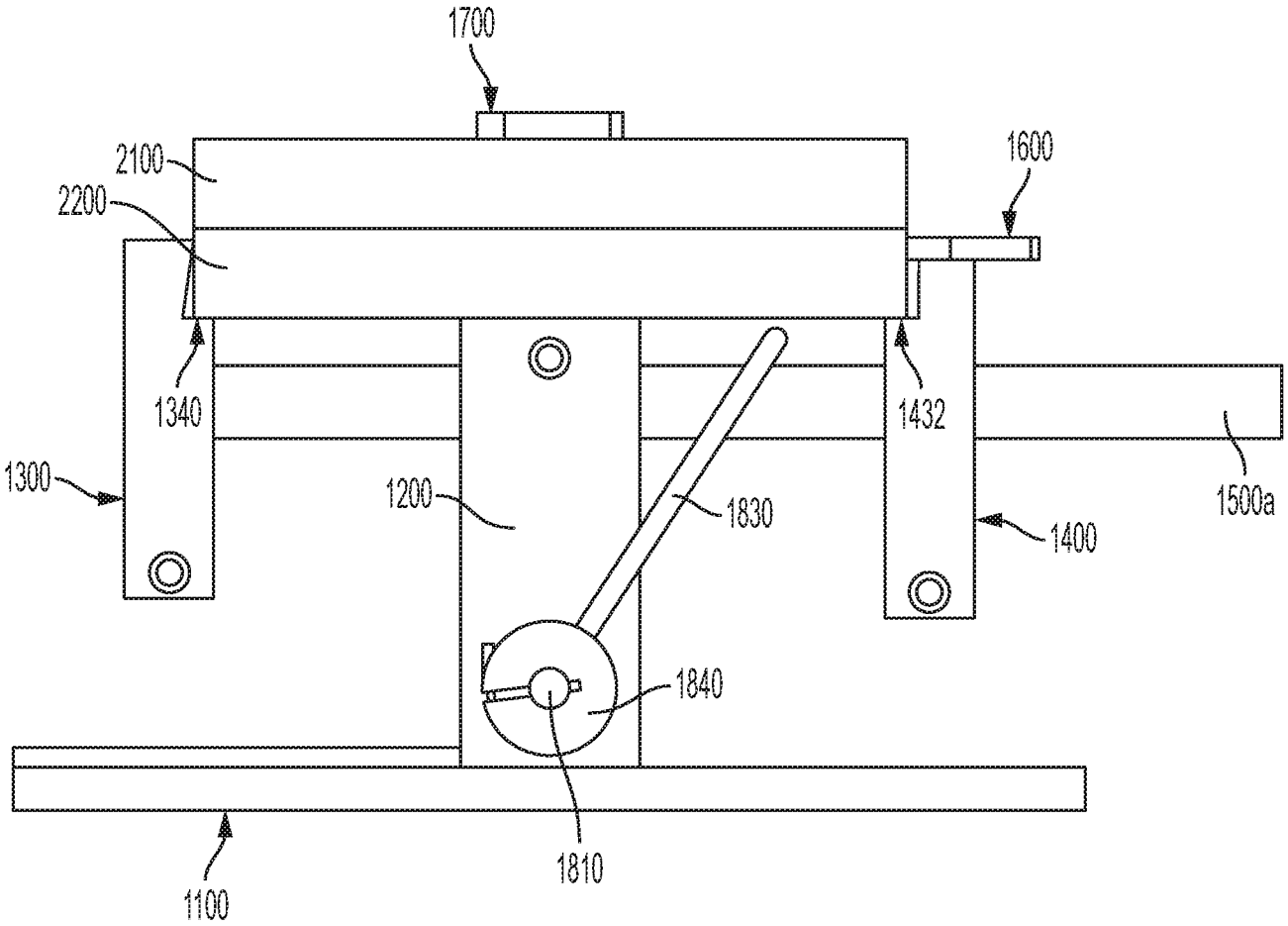
FIG. 9 is a side view of the die holding and lifting system in combination with a die cutter of FIG. 1, according to some embodiments.
Figure 10:
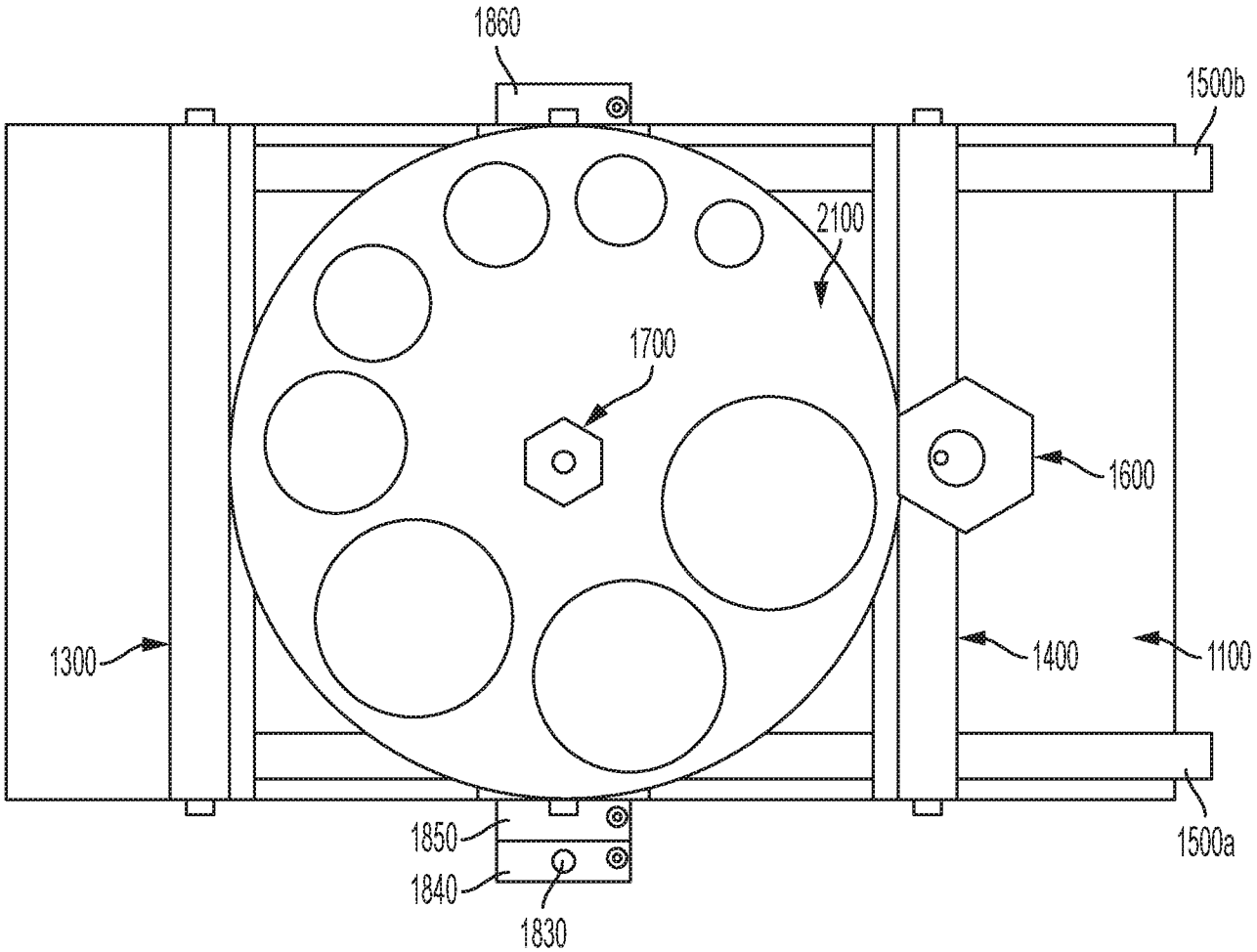
FIG. 10 is a top view of the die holding and lifting system in combination with a die cutter of FIG. 1, according to some embodiments.

Turning now to FIGS. 9 and 10, an assembly of the system 1000 with the die cutter 2000 is shown. FIG. 9 is a side view of the system 1000 in conjunction with the die cutter 2000. FIG. 10 is a top view of the system 1000 in conjunction with the die cutter 2000. As shown, the die cutter 2000 is received by the system 1000 or otherwise positioned thereon such that the die cutter 2000 is supported by one or more of the riser 1200, the first stop bar 1300 and the second stop bar 1400. In various examples, the lower die plate 2200 of die cutter 2000 is supported by flanges 1340 and 1432 of the first stop bar 1300 and the second stop bar 1400, respectively. The first and second stop bar rails 1500*a* and 1500*b* extend through the riser 1200, and the first and second stop bars 1300 and 1400 are coupled thereto.

In some examples, the first and second stop bars 1300 and 1400 are secured to the first and second stop bar rails 1500*a* and 1500*b* by way of one or more fasteners, such as one or more set screws, as discussed above. In some examples, one or more of the first and second stop bars 1300 and 1400 may be press fit onto one or more of the first and second stop bar rails 1500*a* and 1500*b*.

Figure 11:
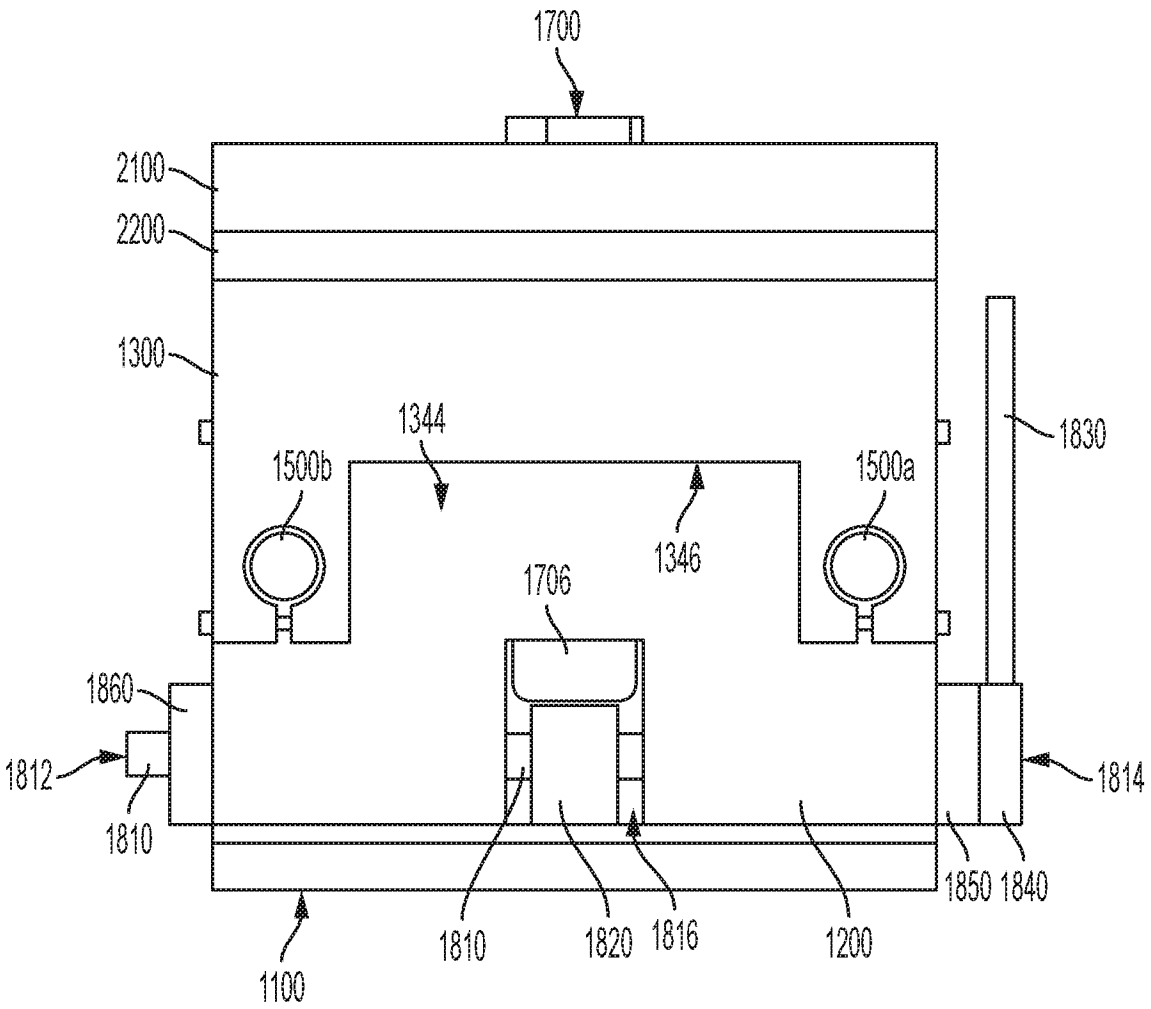
FIG. 11 is a front view of the die holding and lifting system in combination with a die cutter of FIG. 1 in a closed configuration, according to some embodiments.

In various examples, the first and second stop bars 1300 and 1400 are supported by the first and second stop bar rails 1500*a* and 1500*b* such that, when supporting the die cutter 2000, the die cutter 2000 is offset from the base 1100 a distance sufficient to allow a cutting member (not shown) that is used in combination with the die cutter 2000 to be retrieved without having to remove the die cutter 2000 from the system 1000. That is, after the cutting member is forced through one of the die cutter guides (such as die cutter guide 2104), the cutting member can be retrieved without removing the die cutter 2000 from the system 1000. In some examples, one or more of the first and second stop bars 1300 and 1400 include a relief that is configured to accommodate removal or retrieval of the cutting member after is has been forced through the die cutter 2000. For example as shown in FIG. 11, the first stop bar 1300 includes a relief 1344 having a recessed surface 1346. When positioned on the first and second stop bar rails 1500*a* and 1500*b* the recessed surface 1346 is offset from the base 1100 by an amount sufficient to accommodate retrieval of a cutting member. In some examples, a distance between the base 1100 and the recessed surface 1346 is greater than a distance between the base 1100 and the bottom surfaces 1320 and 1334 of the first and second stop bar rail interface features 1314 and 1328. Put differently, in various examples, the first stop bar 1300 is configured such that a distance between the top 1304 and the recessed surface 1346 is less than a distance between the top 1304 and the bottom surfaces 1320 and 1334 of the first and second stop bar rail interface features 1314 and 1328.

As shown in FIG. 9, a wedge clamp 1600 is coupled to the second stop bar 1400. In various examples, the wedge clamp 1600 operates as a secondary clamping mechanism for securing the die cutter 2000 between the first and second stop bars 1300 and 1400. An exemplary wedge clamp 1600 is also shown in FIGS. 8A-8C. In various examples, the wedge clamp generally includes a block component 1602 and a camming component 1604. The camming component 1604 is situated within a recess of the block component 1602 and is rotatable relative thereto. In various examples, the camming component 1604 includes an eccentricity or a lobe 1606. As the camming component 1604 is rotated relative to the block component 1602, the lobe 1606 reacts against the recess of the block component 1602 (e.g., against a surface of the recess), causing the block component 1602 to move. Those of skill in the art will appreciate that as the camming component 1604 is revolved, the block component will translate forward and backward relative to the second stop bar 1400. Specifically, with regard to the configuration illustrated in FIGS. 8A-8C, the block component 1602 is configured to translate forward and backward relative to the front 1412 and the back 1414 of the second stop bar 1400 depending on an angular position of the lobe 1606 and a direction of rotation of the camming component 1604.

Turning back now to FIGS. 9 and 10, those of skill in the art will appreciate that translating the block component 1602 forward relative to the front 1412 (or otherwise away from the back 1414) of the second stop bar 1400 operates to apply force to the die cutter 2000 that influences the die cutter 2000 toward the first stop bar 1300. It will be appreciated that this advancement of the block component 1602 operates to clamp or wedge the die cutter 2000 between the block component 1602 and first stop bar 1300. In some examples, the die cutter 2000 is clamped between the edge 1342 of the first stop bar 1300 and the block component 1602. Similarly, translating the block component 1602 backward relative to the front 1412 (or otherwise toward the back 1414) of the second stop bar 1400 operates to remove any clamping force exerted on the die cutter 2000, thereby allowing for the die cutter 2000 to be subsequently removed from the system 1000. Thus, in various examples, the system 1000 includes one or more features that provide for selectively coupling the die cutter 2000 to the system 1000.

While the wedge clamp 1600 is illustrated as being coupled to the top 1404 of the second stop bar 1400, it should be appreciated that a wedge clamp 1600 may alternatively or alternatively be coupled to the second stop bar 1400 at a position between the top 1404 and the flange 1432. In various examples, the wedge clamp 1600 may be situated in a recess positioned between the top 1404 and the flange 1432 of the second stop bar 1400 (and/or between the top 1304 and the flange 1340 of the first stop bar). That is, in some examples (not shown) a recess is formed in the second stop bar 1400 between the top 1404 and the flange 1432 and is configured to house the wedge clamp 1600 (though the size and shape of the wedge clamp will differ from that illustrated in FIGS. 10 and 11). In some examples, the recess is formed in the surface that extends between the top 1404 and the flange 1432. In some such examples, the camming component 1604 is accessible from the top 1404 (or the bottom 1406) of the second stop bar 1400 (or from the top 1304 or bottom of the first stop bar 1300) as those of skill will appreciate.

Additionally, while the above-discussed examples include a wedge clamp 1600 that is coupled to the second stop bar, one or more wedge clamps may additionally or alternatively be coupled to the first stop bar in a manner similar to the manner in which the wedge clamp 1600 is coupled to the second stop bar. Thus, in various examples, the system 1000 may include a plurality of wedge clamps 1600.

As mentioned above, in various examples, the system 1000 includes a separation assembly that operates to cause a separation between the upper and lower die plates 2100 and 2200. In various examples, the system 1000 further includes one or more components that operate to cause activation of the separation assembly 1700 and thus actuation of the die cutter 2000. In particular, in various examples, the system 1000 includes one or more mechanisms that interact with the separation assembly 1700 to cause repetitious separation of the upper and lower die plates 2100 and 2200.

With reference now to FIG. 11, actuation assembly 1800 of the system 1000 is shown. FIG. 11 is a front view of the system 1000. In various examples, the actuation assembly 1800 includes a shaft 1810, a cam 1820, and a lever 1830. In some examples, the shaft 1810 is an elongate element that extends through a portion of the riser 1200 and is operable to be rotated relative thereto. In some examples, the shaft 1810 is cylindrical. The shaft 1810 generally includes a first end 1812, a second end 1814, and an intermediate portion 1816 extending between the first and second ends 1812 and 1814. Generally, the actuation assembly 1800 operates in accordance with the separation assembly 1700 to cause actuation (separation and/or drawing together) of the upper and lower die plates 2100 and 2200, as will be discussed further below. In some examples, one or more collars operate to couple the lever 1830 to the shaft 1810 and to maintain a position of the shaft 1810 relative to the riser 1200. For example, as shown in FIGS. 9 to 12, a first collar 1840 couples the lever 1830 to the shaft 1810. Such a configuration provides that the lever 1830 can be coupled to the shaft on either side of the riser 1200 to accommodate user preference.

It will be appreciated that, in various alternative examples, the lever may be welded, press fit, or integral with the shaft 1810. Additionally, as shown, a second and a third collar 1850 and 1860 couple to shaft 1810 and maintain a position of the shaft 1810 relative to the riser 1200. It will be appreciated, however, that alternative means may be utilized to maintain a position of the shaft 1810 relative to the riser 1200. That is, the example configurations of FIGS. 9 to 12 should not be construed as limiting, and alternative means of coupling the shaft 1810 to the riser 1200 such that the shaft 1810 can rotate relative to the bore 1232 may be utilized without departing from the spirit or scope of the present disclosure.

In various examples, the cam 1820 is a projection that extends from a portion of the shaft 1810 and that is configured to make sliding contact with the retention member 1706 of the separation assembly 1700. This sliding contact is operable to impart reciprocal or variable motion to the retention member 1706 as the shaft 1810 is rotated, which in turn imparts reciprocal or variable motion to one or more of the upper and lower die plates 2100 and 2200. In various examples, the cam 1820 is configured with the shaft 1810 such that as the shaft 1810 is rotated, the cam 1820 elevates the retention member 1706 relative to the riser 1200. In some examples, the cam 1820 is a radial projection of a portion of the shaft 1810. In some examples, the cam 1820 is noncircular and includes an eccentricity or a lobe. In some examples, the cam 1820 is positioned on the shaft 1810 such that a longitudinal axis of the cam 1820 is laterally offset relative to a longitudinal axis of the shaft 1810. Put differently, in some examples, the cam 1820 and the shaft 1810 are not concentric.

Figure 14:
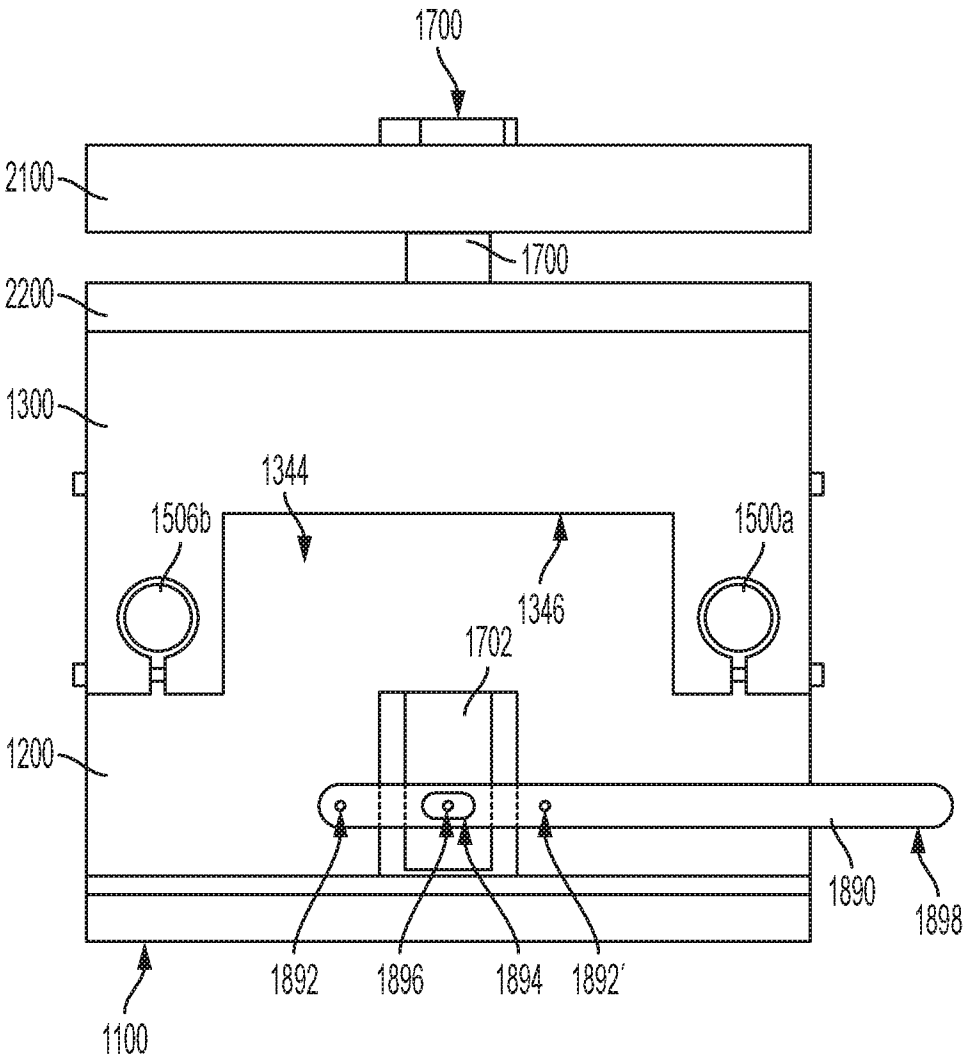
FIG. 14 is a front view of a die holding and lifting system in combination with the die cutter of FIG. 1 in an open configuration, according to some embodiments.

As shown in FIG. 14, the cam 1820 includes a body 1822 having an exterior periphery 1824 that is curved. In some examples, the exterior periphery 1824 has a uniform curvature (e.g., circular) and includes a longitudinal axis, while the curvature varies in other examples (e.g., eccentricity or oblong). The curvature of the exterior periphery 1824 shown in FIG. 14 is generally uniform. For example, as show in FIG. 14, a longitudinal axis of the shaft 1810 about which the cam 1820 rotates is offset relative to a longitudinal axis of the shaft 1810 (e.g., the shaft 1810 is not concentric with the cam 1820). As discussed in greater detail below, a deviation of the orbit of the cam 1820 from circularity operates to impart the reciprocal or variable motion to the retention member 1706 and one or more of the upper and lower die plates 2100 and 2200.

In various examples, the cam 1820 is integral to the shaft 1810. In some examples, the cam 1820 is removably coupled to the shaft 1810. In some examples, the cam 1820 is coupled to the shaft 1810 via welding, an interference fit, or any suitable means, as those of skill in the art will appreciate. As shown in FIG. 11, the cam 1820 is coupled to the shaft 1810 at a position along the shaft 1810 between a first and a second ends 1812 and 1814 of the shaft 1810. In various examples, the riser 1200 includes a relief or channel 1234 that is sized and configured to accommodate the cam 1820 of the actuation assembly 1800. Turning back now to FIGS. 6A-6C, in some examples, the relief or channel 1234 is formed in the bottom 1206 of the riser 1200 at a position between the first and second sides 1208 and 1210. In some examples, the channel 1234 extends from the first face 1212 to the second face 1214. In some examples, the channel 1234 includes a first interior face 1236, a second interior face 1238, and an upper face 1240. In various examples, the channel 1234 is configured to accommodate the cam 1820 such that the cam 1820 can be rotated therein.

In various examples, the riser 1200 further includes one or more additional features configured to accommodate the actuation assembly 1800. For example, as shown in FIG. 6D, a bore 1232 is formed in the riser 1200. In some examples, the bore 1232 is formed in the second side 1210 (or alternatively or additionally in the side 1208) and extends through a portion of or the entirety of the riser 1200. As shown in FIG. 11, the shaft 1810 extends through the bore 1232 and the cam 1820 is positioned along the shaft 1810 such that the cam 1820 is positioned within the channel 1234.

In various examples, the riser 1200 further includes one or more additional features configured to accommodate the separation assembly 1700. For example, as shown in FIGS. 6A and 6C, a bore 1242 is formed in the riser 1200 and extends from a top 1204 of the riser 1200 to an upper face 1240 of the channel 1234. In various examples, the bore 1242 is an aperture through which a portion of the separation assembly 1700 extends such that the separation assembly 1700 can interface with and engage the actuation assembly 1800.

Figure 12:
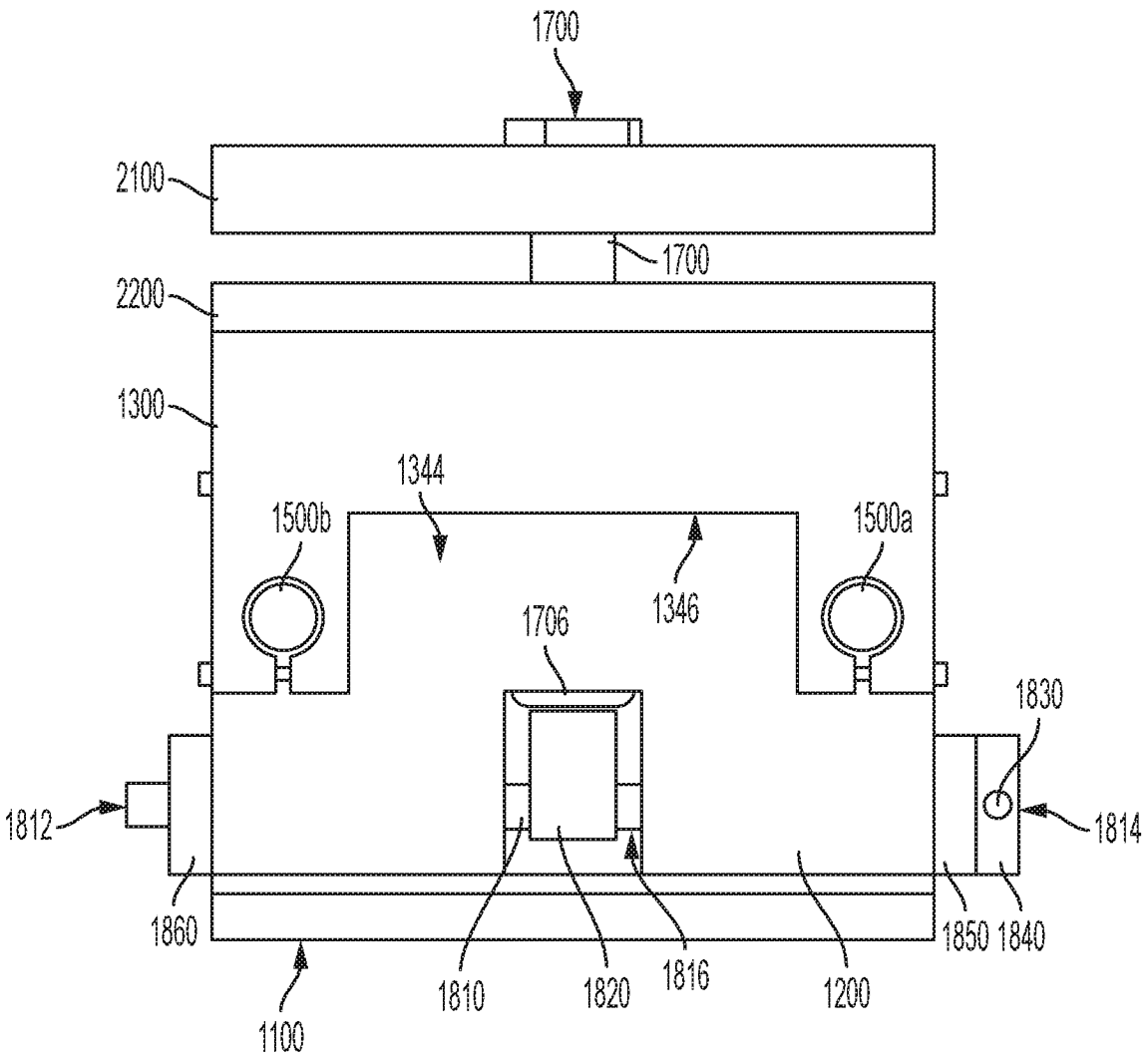
FIG. 12 is a front view of the die holding and lifting system in combination with a die cutter of FIG. 1 in an open configuration, according to some embodiments.

As shown in FIGS. 11 and 12, the separation assembly 1700 and the actuation assembly 1800 are each received by the riser 1200 such that they are operable to engage one another. As shown, the retention member 1706 of the separation assembly 1700 extends into the channel 1234 and is situated adjacent the cam 1820 of the actuation assembly 1800. As the shaft 1810 is rotated, the retention member 1706 follows an edge of the cam 1820. Put differently, the retention member 1706 operates as a cam follower, as those of skill will appreciate. In various examples, the eccentricity of the cam 1820 causes the axial member 1702 of the separation assembly 1700 to translate as the shaft 1810 and the cam 1820 are rotated. As discussed above, this translation of the axial member 1702 causes at least of the upper and lower die plates 2100 and 2200 to translate relative to the other of the upper and lower die plates 2100 and 2200.

Operation of the system 1000 in combination with the die cutter 2000 is illustrated in FIGS. 11 and 12. FIG. 11 is a front view of the system 1000 with a die cutter 2000 mounted on the system 1000. The system 1000 is illustrated in FIG. 11 in a closed configuration (e.g., the upper and lower die plates 2100 and 2200 of the die cutter 2000 are not separated). FIG. 12 is a front view of the system 1000 and die cutter 2000 of FIG. 11 in an open configuration (e.g., the upper and lower die plates 2100 and 2200 of the die cutter are separated from one another, see e.g., FIG. 4). Accordingly, as shown in FIGS. 11 and 12 the system 1000 is transitionable between the closed configuration and the open configuration. It will be appreciated that when the system 10000 is in the closed configuration, the separation assembly 1700 is in a closed configuration (e.g., FIG. 5), as discussed above. Likewise when the system 10000 is in the open configuration, the separation assembly 1700 is in an open configuration, as discussed above.

In various examples, prior to actuating the actuation assembly 1800, the separation assembly 1700 is coupled with a die cutter 2000, and the combined assemblies of the die cutter 2000 and the separation assembly 1700 are assembled onto the system 1000.

Referring back now to FIGS. 2 and 3, in various examples, a separation assembly 1700 is coupled with the die cutter 2000. In some examples, the upper and lower die plates 2100 and 2200 of the die cutter 2000 include a central bore 2112 and 2212, respectively. In some examples, the axial member 1702 of the separation assembly 1700 is coupled with one of the upper and lower die plates 2100 and 2200. While the illustrated examples of FIGS. 2 and 3 show a plurality of fastening members 1708 and 1710, it will be appreciated that the axial member 1702 may be coupled with one of the upper and lower die plates 2100 and 2200 in a variety of way, as discussed herein. The nonlimiting example of FIGS. 2 and 3 includes a first fastening member 1708 and a second fastening member 1710 (e.g., wedge nut). As shown, the first fastening member 1708 and the second fastening member 1710 are coupled together such that the upper die plate 2100 is sandwiched between ends of the first and second fastening members 1708 and 1710. In particular, the first fastening member 1708 includes an elongate portion 1712 that extends through the bore 2112 of the upper die plate 2100. The elongate portion 1712 includes a threaded exterior 1714 and a threaded interior bore 1716. In various examples, the second fastening member 1710 includes a threaded interior bore that is configured to mate with the threaded exterior 1714 of the first fastening member 1708. In some examples, the second fastening member 1710 is a nut.

In various examples, the elongate portion 1712 of the first fastening member 1710 is received within the bore 2112 of the upper die plate 2100 from the top 2106 and extends through the upper die plate 2100 such that the second fastening member 1710 can be threadedly mated with the first fastening member 1708 at the bottom 2108. In some examples, the first fastening member 1708 includes a head 1718 that is larger in cross section than is the elongate portion 1712 and the bore 2112 of the upper die plate 2100. In various examples, the head 1718 prevents the first fastening member 1708 from being pulled through the bore 2112 of the upper die plate 2100 as those of skill will appreciate. In various examples, the second fastening member 1710 is threaded onto the first fastening member 1708 in a manner that sandwiches the upper die plate 2100 between the head 1718 of the first fastening member 1708 and the second fastening member 1710. In some examples, one or more of the upper and lower die plates include a recess configured to receive the second fastening member therein. For example, as shown, the second fastening member 1710 is received within a recess 2114 of the upper die plate 2100. It will be appreciated that such a recess provides that the second fastening member 1710 can be coupled with the first fastening member 1708 without preventing the upper and lower die plates 2100 and 2200 from collapsing against one another such that the bottom 2108 of the upper die plate 2100 contacts the top 2206 of the lower die plate 2200.

It will be appreciated that a variety of alternative examples are envisioned for coupling the first fastening member 1708 to one of the upper and lower die plates 2100 and 2200, and that the illustrated examples of FIGS. 2 and 3 should not be construed as limiting. For instance, in another nonlimiting example, one or more of the bores 2112 and 2212 of the upper and lower die plates 2100 and 2200, respectively, are threaded such that the first fastening member 1708 can be threaded into a bore of one of the upper and lower die plates 2100 and 2200. Alternatively, in some examples, the axial member may be threaded directly into one of the bores 2112 or 2212 of the upper and lower die plates 2100 and 2200, respectively. Alternatively, as mentioned above, the axial member 1702 may be coupled to one of the upper and lower die plates 2100 and 2200 via some other fastening means (e.g., welding, press fitting, etc.), as discussed herein.

With continued reference to FIGS. 2 and 3, in various examples, the axial member 1702 is threaded into the interior threaded bore 1716 of the first fastening member 1708. As shown, the axial member 1702 is threaded into the interior threaded bore 1716 such that a portion of the axial member 1702 extends below the bottom 2108 of the upper die plate 2100. In some examples, the lower die plate 2200 is disposed over the axial member 1702 such that the axial member 1702 extends through the bore 2212 of the lower die plate 2200 and below the bottom 2208 of the lower die plate 2200. In various examples, the biasing member 1704 is disposed over the portion of the axial member 1702 that extends below the bottom 2208 of the lower die plate 2200. In various examples, a retention member 1706 is threaded onto the axial member 1702 such that the biasing member is positioned between the retention member 1706 and the bottom 2208 of the lower die plate 2200. As mentioned above, a variety of alternative configurations are envisioned wherein a biasing member may additionally or alternatively be positioned between the upper and lower die plates 2100 and 2200 and/or above the top 2106 of the upper die plate 2100.

In various examples, the subassembly consisting of the die cutter 2000 and the separation assembly 1700 can be coupled with the system 1000 such that the actuation assembly 1800 can be utilized to cause a repeatable separation of the upper and lower die plates 2100 and 2200 during a cutting, punching, or stamping process. In various examples, the subassembly including the die cutter 2000 and the separation assembly 1700 is coupled with the system 1000 by inserting one or more portions of the separation assembly 1700 in the bore 1242 of the riser 1200. As shown in FIGS.

9 to 12, the subassembly consisting of the die cutter 2000 and the separation assembly 1700 is received such that the retention member 1706, the biasing member 1704, and a portion of the axial member 1702 are disposed within the bore 1242 of the riser 1200. As shown in FIG. 11, at least a portion of the subassembly consisting of the die cutter 2000 and the separation assembly 1700 extends through the bore 1242 and projects into the channel 1234 of the riser 1200. Such a configuration provides that the actuation assembly 1800 can engage a portion of the separation assembly 1700.

In various examples, one or more portions of the system 1000 are configured to hold one of the upper and lower die plates 2100 and 2200 while the actuation assembly 1800 and the separation assembly 1700 cause the other of the upper and lower die plates 2100 and 2200 to translate. As shown in FIGS. 9 to 12, the first and second stop bars 1300 and 1400 (including the wedge clamp 1600) engage one of the upper and lower die plates 2100 and 2200 and maintain a position of the engaged die plate while the actuation assembly 1800 and the separation assembly 1700 cause the other of the upper and lower die plates 2100 and 2200 to translate. As shown, a position of one or more of the first and second stop bars 1300 and 1400 can be adjusted relative to the riser 1200 for accommodating die cutters of varying shapes and sizes. Additionally or alternatively, as shown, a position of one or more of the first and second stop bar rails 1500*a* and 1500*b* can be adjusted relative to the riser 1200.

Referring now to FIGS. 11 and 12, in various examples, the system 1000 is transitioned between the open and closed configurations by rotating the shaft 1810 about its longitudinal axis. It will be appreciated that while the illustrated examples of FIGS. 11 and 12 include a lever 1830 that is actuated to cause a rotation of the shaft 1810 and the cam 1820, a variety of other mechanisms may be utilized to cause a rotation of the shaft 1810 without departing from the spirit or scope of the present disclosure. For example, the shaft 1810 may be coupled to a foot pedal such that the shaft 1810 is rotated as the foot pedal is actuated or depressed. Additionally, the shaft 1810 may be coupled to a press such that the shaft 1810 is rotated to a position corresponding to a closed configuration as the press descends upon the die cutter 2000 and such that the shaft 1810 is rotated to a position corresponding to an open configuration as the press retracts away from the die cutter 2000 such that the stock material can be moved and the process can be repeated to press or cut another part out of the stock material.

As shown, as the shaft 1810 (and thus the cam 1820) is rotated, the cam 1820 engages the separation assembly 1700 and causes one or more components of the separation assembly 1700 to translate. In some examples, rotation of the cam 1820 from a first position to a second position causes the one or more components of the separation assembly 1700 to translate away from the base 1100, while rotation of the cam 1820 from the second back to the first position causes the one or more components of the separation assembly 1700 to translate toward the base 1100.

In some examples, the cam 1820 can be rotated from a first position to a second position, thereby causing the one or more components of the separation assembly 1700 to translate away from the base 1100, while rotating the cam 1820 from the second position to a third position causes the one or more components of the separation assembly 1700 to translate toward the base 1100. It will also be appreciated that, in various examples, the cam 1820 may be configured such that rotation of the shaft in either direction from an initial position causes a displacement of the separation assembly 1700 that results in one or more components of the separation assembly 1700 translating away from the base 1100 (e.g., separation of the upper and lower die plates 2100 and 2200), and wherein rotation back to the initial position causes a displacement of the separation assembly 1700 that results in one or more components of the separation assembly 1700 translating toward the base 1100 (e.g., collapsing of the upper and lower die plates 2100 and 2200 together or toward one another). In some nonlimiting examples, rotation from the first position to the second position includes rotating the cam 1820 approximately ninety (90) degrees, and rotating the cam from the first position to the third position includes rotating the cam 1820 approximately one hundred eighty (180) degrees.

In various examples, this translation of the one or more components of the separation assembly 1700 away from the base 1100 causes one of the upper and lower die plates 2100 and 2200 to translate away from another of the upper and lower die plates 2100 and 2200. Specifically, as shown in FIGS. 11 and 12, as the cam 1820 is rotated, the cam 1820 engages the retention member 1706 and causes the retention member 1706 to translate away from the base 1100. This translation of the retention member 1706 away from the base 1100 causes the axial member 1702 to translate away from the base 1100, which causes the upper die plate 2100 to translate away from the base 1100. In this example, because the first and second stop bars 1300 and 1400 (and the wedge clamp 1600) cause a position of the lower die plate 2200 is to be maintained relative to the riser 1200 (and thus the base 1100) as the cam 1820 is rotated, the upper die plate 2100 is translated away from the lower die plate 2200.

Likewise, translation of the one or more components of the separation assembly 1700 toward the base 1100 causes one of the upper and lower die plates 2100 and 2200 to translate toward another of the upper and lower die plates 2100 and 2200. This translation of the one or more components of the separation assembly 1700 (e.g., the retention member 1706) toward the base 1100 causes the axial member 1702 to translate toward the base 1100, which causes the upper die plate 2100 to translate toward the base 1100. In this example, because the first and second stop bars 1300 and 1400 (and the wedge clamp 1600) cause a position of the lower die plate 2200 is to be maintained relative to the riser 1200 (and thus the base 1100) as the cam 1820 is rotated, the upper die plate 2100 is translated toward the lower die plate 2200.

In various examples, the amount by which the upper and lower die plates 2100 and 2200 can be separated (e.g., linear travel distance) when transitioned to the open configuration can be adjustable. For instance, as mentioned above, in some examples, the axial member 1702 is a threaded member that can be threadedly coupled to one of the upper and lower die plates 2100 and 2200. Thus, in various examples, an amount the axial member 1702 is threaded into one of the upper and lower die plates 2100 and 2200 can be increased or decreased. In such examples, increasing the amount the axial member 1702 is threaded into the upper or lower die plate 2100 and 2200 reduces the degree of separation between the upper and lower die plates 2100 and 2200 when transitioned to the open configuration. Likewise, decreasing the amount the axial member 1702 is threaded into the upper or lower die plate 2100 and 2200 increases the degree of separation between the upper and lower die plates 2100 and 2200 when transitioned to the open configuration. In some examples, such variability is achieved because a smaller portion of the cam 1820 (e.g., a smaller portion of the edge of the cam 1820) engages the separation assembly 1700 when a greater length of the axial member 1702 is threaded into the upper or lower die plate 2100 and 2200. Additionally or alternatively, the linear travel distance of die lifting assembly may be varied by interchanging the cam 1820 with one or more other cams having different profiles (e.g., different lobe profiles having different max lobe offsets and/or different rates of change or curvatures between a maximum lobe offset and a minimum offset).

While the illustrations and examples discussed above include a lever and camming element that operate to cause a separation of the upper and lower die plates, these examples and illustrations should not be construed as limiting. For example, it will be appreciated alternative systems may utilize one or more gear systems (e.g., worm, spur, ratchet/pawl, rack/pinion) with rotational and/or linear translation to cause such separation of the upper and lower die plates. For example, turning now to FIGS. 13 and 14, several alternative configurations are illustrated.

Figure 13:
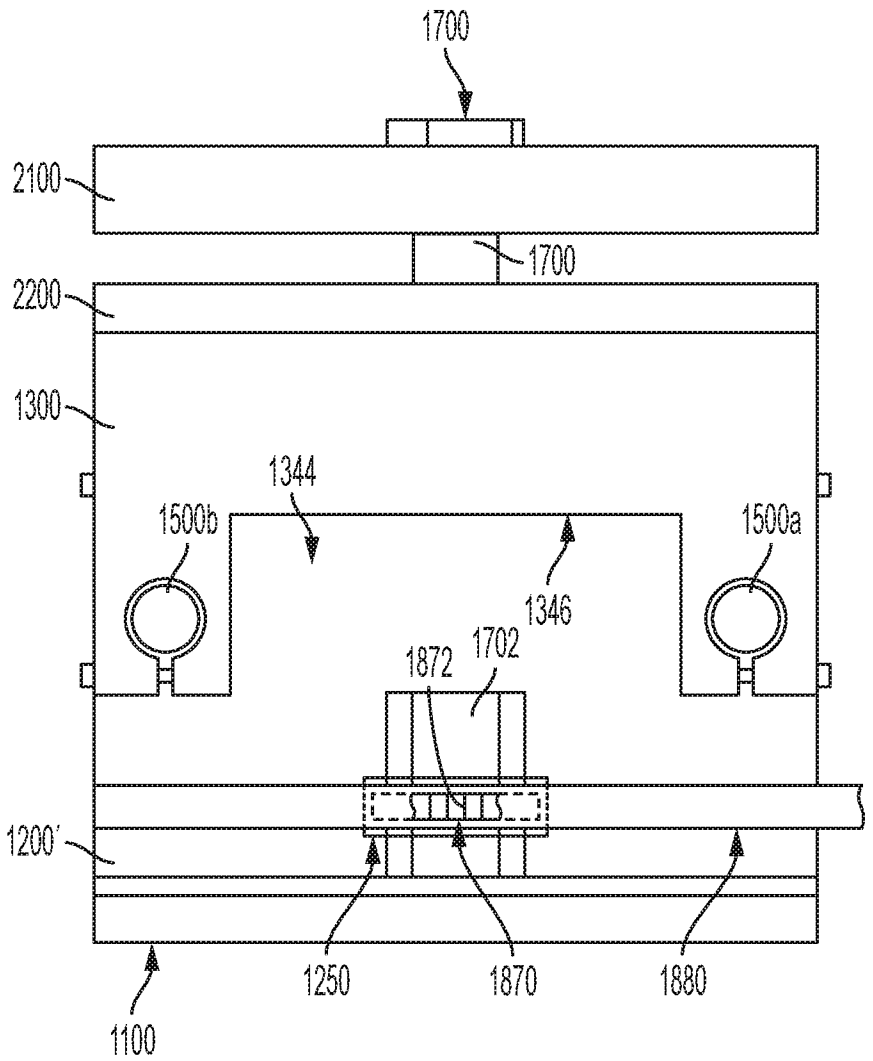
FIG. 13 is a front view of a die holding and lifting system in combination with the die cutter of FIG. 1, according to some embodiments.

FIG. 13 includes a rack and pinion type configuration as an alternative to the camming element discussed above. In some examples, the axial member 1702 has a threaded end that extends through the riser 1200 and interfaces with a spur gear, threaded nut, or other element 1870 that is operable to cause linear actuation of the axial member 1702 as the element 1870 is rotated. In some examples, element 1870 is an annular element and includes a threaded bore configured to accommodate the threaded end of axial member 1720 such that relative rotational movement between the element 1870 and the axial member 1702 causes relative axial translation between the element 1870 and the axial member 1702, as those of skill in the art will appreciate.

In some examples, the element 1870 operates in accordance with a rack element 1880. For instance, in some examples, the element 1870 is a spur gear and includes a plurality of teeth about its peripheral edge such that the teeth are operable to interface with the rack element 1880 to translate linear motion of the rack element 1880 to rotational motion of the element 1870, as those of skill will appreciate. A portion of the rack element 1880 has been removed in FIG. 13 to show element 1870 and teeth 1872. It should be appreciated that while element 1870 is shown with teeth 1872 about a peripheral edge, element 1870 may alternatively include teeth along a top or bottom surface thereof without departing from the spirit or scope of the disclosure. The rack element 1880 may extend along the first or second face 1212 and 1214 of riser 1200. Alternatively, the rack element 1880 may extend through a bore made through riser 1200, as those of skill will appreciate.

In some such examples, as the rack element 1880 is actuated (e.g., translated transverse to a longitudinal axis of the axial member 1702), the rack element 1880 causes element 1870 to rotate. Generally, the axial member is constrained against rotational movement relative to one or more of the upper and lower die plates. Thus, as element 1870 rotates, it is rotated relative to axial member 1702, which causes relative axial translation between the element 1870 and the axial member 1702 as discussed above. As shown in FIG. 13, in various examples, one or more features or components constrain the element 1870 from axial translation relative to the riser 1200'. For example, as shown, a relief 1250 is formed in the riser 1200' and sized to accommodate element 1870 and constrain element 1870 against axial translation along the longitudinal axis of the axial member 1702. Accordingly, as those of skill will appreciate, the rotation of element 1870 is transferred to axial translation of the axial member 1702 and thus the upper die plate 2100. It will also be appreciated that the amount of axial translation of the axial member corresponds with the degree through which the element 1870 is rotated.

It will be appreciated that the rack element 1880 may be actuated according to known methods, including such non-limiting examples as, a lever or a mechanical actuation system (e.g., a hydraulic or pneumatic system).

FIG. 14 illustrates an alternative lever-type configuration that includes a lever 1890 that can be actuated to cause axial translation of the axial member 1702. As shown, the lever 1890 is coupled to the riser 1200 and the axial member 1702. In various examples, the lever 1890 is coupled to the riser 1200 at a pivot point 1892. In various examples, the lever 1890 includes a slot 1894, wherein a pin 1896 extends through the slot 1894 and couples to the axial member 1702. Those of skill in the art will appreciate that the slot 1894 provides that, as the lever 1890 is pivoted about the pivot 1892, the walls of the slot 1894 engage the pin 1896 and cause translation of the axial member 1702, and provide that the pin 1986 can translate relative to the slot 1894.

It will be appreciated that while the lever 1890 is shown as being coupled to the riser 1200 at pivot 1892 such that the lever 1890 is coupled to the axial member 1702 between the pivot 1892 and a handle 1898 of the lever 1890, in other examples, the lever 1890 may be coupled to the riser 1200 at a pivot 1892' such that the pivot 1892' is situated between where the lever 1890 is coupled to the axial member 1702 and the handle 1898. Such a configuration provides an inverse relationship between the actuation direction of the axial member 1702 and the lever 1890 (e.g., downward actuation of the handle 1898 results in upward actuation of the axial member 1702). It will be appreciated that the lever 1890 may be actuated according to any known methods including those discussed herein.

Numerous characteristics and advantages have been set forth in the preceding description, including various alternatives together with details of the structure and function of the devices and/or methods. Moreover, the inventive scope of the various concepts addressed in this disclosure has been described both generically and with regard to specific examples. The disclosure is intended as illustrative only and as such is not intended to be exhaustive. It will be evident to those skilled in the art that various modifications may be made, especially in matters of structure, materials, elements, components, shape, size, and arrangement of parts including combinations within the scope of the disclosure, to the full extent indicated by the broad, general meaning of the terms in which the appended claims are expressed. To the extent that these various modifications do not depart from the spirit and scope of the appended claims, they are intended to be encompassed therein.

What is claimed is:

1. A method comprising:

providing a separation assembly comprising an axial member, a retention member, and a biasing member;

providing a die cutter having a first die plate and a second die plate, at least one of the first die plate and the second die plate having one or more openings;

securing the axial member to the first die plate of the die cutter;

positioning the second die plate along the axial member such that the axial member extends through a bore of the second die plate and such that the second die plate is in a sliding relationship with the axial member;

disposing the biasing member about the axial member;

securing the retention member to the axial member such that the biasing member is situated between the retention member and the second die plate, and such that the biasing member is in an abutting relationship with each of the retention member and the second die plate; and wherein in an operational state after the securing steps, the one or more openings are open for receiving a punch configured for driving into material positioned between the first die plate and the second die plate.

2. The method of claim 1, further comprising:

providing a holding and lifting apparatus comprising:

a base;

a riser coupled to the base;

a plurality of stop bars coupled to the riser; and an actuation assembly including a cam element that is rotatable relative to the base;

positioning the die cutter on the holding and lifting apparatus such that die cutter is supported by the plurality of stop bars and such that the separation assembly is situated adjacent the actuation assembly.

3. The method of claim 2, wherein the separation assembly is situated such that an actuation of the actuation assembly is operable to cause the cam element to displace the axial member and the first die plate.

4. The method of claim 2, further comprising securing one or more of the first and second die plates between the plurality of stop bars.

5. The method of claim 2, wherein one or more of the axial member, the retention member, and the biasing member of the separation assembly extends into a bore of the riser.

6. A method comprising:

providing a separation assembly comprising an axial member, a retention member, and a biasing member;

providing a die cutter having a first die plate and a second die plate;

securing the axial member to the first die plate of the die cutter;

positioning the second die plate along the axial member such that the axial member extends through a bore of the second die plate and such that the second die plate is in a sliding relationship with the axial member;

disposing the biasing member about the axial member;

securing the retention member to the axial member such that the biasing member is situated between the retention member and the second die plate, and such that the biasing member is in an abutting relationship with each of the retention member and the second die plate;

providing a holding and lifting apparatus comprising a base, a riser coupled to the base, a plurality of stop bars coupled to the riser, and an actuation assembly including a cam element that is rotatable relative to the base; and positioning the die cutter on the holding and lifting apparatus such that die cutter is supported by the plurality of stop bars and such that the separation assembly is situated adjacent the actuation assembly.

* * * * *